US007585045B2

(12) United States Patent
Yamanobe

(10) Patent No.: US 7,585,045 B2
(45) Date of Patent: Sep. 8, 2009

(54) IMAGE FORMING METHOD AND IMAGE FORMING APPARATUS

(75) Inventor: Jun Yamanobe, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 98 days.

(21) Appl. No.: 11/956,008

(22) Filed: Dec. 13, 2007

(65) Prior Publication Data

US 2008/0150987 A1 Jun. 26, 2008

(30) Foreign Application Priority Data

Dec. 20, 2006 (JP) ..... 2006-343264

(51) Int. Cl.
*B41J 29/393* (2006.01)

(52) U.S. Cl. ..... 347/19

(58) Field of Classification Search ..... 347/12, 347/15, 40, 43, 19; 358/504
See application file for complete search history.

(56) References Cited

U.S. PATENT DOCUMENTS

| | | | | |
|---|---|---|---|---|
| 6,739,699 | B1 * | 5/2004 | Sender et al. | 347/43 |
| 7,325,900 | B2 * | 2/2008 | Hayashi et al. | 347/41 |
| 2005/0073547 | A1 * | 4/2005 | Endo | 347/109 |
| 2005/0243126 | A1 | 11/2005 | Takahashi et al. | |
| 2007/0024663 | A1 | 2/2007 | Yamanobe | |

FOREIGN PATENT DOCUMENTS

| | | | |
|---|---|---|---|
| JP | 2005-313570 | A | 11/2005 |
| JP | 2007-30363 | A | 2/2007 |

* cited by examiner

*Primary Examiner*—Lamson D Nguyen
(74) *Attorney, Agent, or Firm*—Birch, Stewart, Kolasch & Birch, LLP

(57) ABSTRACT

The image forming method of ejecting liquid droplets containing coloring material toward a recording medium from nozzles including main nozzles and subsidiary nozzles of nozzle rows of a recording head while causing relative movement between the recording medium and the recording head in a relative movement direction that is substantially perpendicular to a direction of alignment of the nozzles of each of the nozzle rows in such a manner that an image is formed by the coloring material on a recording medium, wherein the nozzle rows include first and second nozzle rows which have the main nozzles corresponding to a same coloring material of a particular color and at least one subsidiary nozzle row which includes the subsidiary nozzles corresponding to the same coloring material of the particular color; the first and second nozzle rows and the at least one subsidiary nozzle row are respectively arranged at different positions in terms of the relative movement direction; the at least one subsidiary nozzle row is disposed between the first and second nozzle rows; the subsidiary nozzles are arranged in such a manner that positions of the subsidiary nozzles projected on a straight line in the direction of alignment of the nozzles of each of the nozzle rows are different from positions of the main nozzles projected on the straight line, includes: a measurement step of measuring an amount of inclination of the recording head with respect to the relative movement direction; a correction judgment step of judging whether or not correction is necessary according to the amount of inclination measured in the measurement step; and a correction step of canning out droplet ejection from at least a portion of the subsidiary nozzles, in place of droplet ejection from at least a portion of the main nozzles when judgment is made, in the correction judgment step, that the correction is necessary, in such a manner that the correction is carried out.

13 Claims, 21 Drawing Sheets

IMAGE FORMING METHOD AND IMAGE FORMING APPARATUS

BACKGROUND OF THE INVENTION

1. Field of the Invention

The present invention relates to an image forming method and an image forming apparatus, and more particularly, to an image forming method and an image forming apparatus for recording a desired image by ejecting droplets onto a recording medium while moving a recording head (e.g. inkjet head) provided with a nozzle row which ejects ink droplets and the recording medium relatively with respect to each other.

2. Description of the Related Art

In order to record an image of high quality at high resolution with a serial type inkjet printer which records images onto a recording medium while a recording head is moved reciprocally, a recording head is known which has a composition where the ink ejection nozzles are increased in number only in respect of particular colors (for example, cyan and magenta), and these nozzles are disposed in symmetrical positions with respect to the center of the recording head (see FIG. 1 in Japanese Patent Application Publication No. 2005-313570).

By using a recording head having the nozzle arrangement disclosed in Japanese Patent Application Publication No. 2005-313570, when droplets of inks of a plurality of different types (colors) are ejected in a superimposed fashion in bidirectional printing, it is possible to ensure that the colors are superimposed on each other in substantially the same way (for example, printing cyan first and then yellow (i.e. printing in the order of "cyan→yellow") and printing yellow first and then cyan (i.e. printing in the order of "yellow→cyan") are carried out substantially the same number of times, respectively), and therefore the stability of secondary colors can be improved. Moreover, a merit is obtained in that when a high-quality mode is selected, it is possible to record at high resolution using all of the nozzle rows c1 to c4 (or nozzle rows m1 to m4), in respect of particular colors (for example, cyan and magenta).

However, in a recording head having the composition disclosed in the Japanese Patent Application Publication No. 2005-313570, when "normal recording mode" is selected, only the main nozzle rows c1 and c2 (or m1 and m2) are used. Therefore, if a recording head having a nozzle arrangement of this kind is installed at an oblique inclination with respect to the prescribed installation position (the standard installation position according to the design) and the head is then used in normal recording mode, the effective pitch between the nozzles will not be uniform, and there is a possibility that band-shaped non-uniformities may occur in the resulting image (recorded image).

FIG. 21 shows a schematic view of causes of the banding non-uniformities described above. Here, for the sake of convenience, only the cyan main nozzle rows c1 and c2, and the yellow nozzle rows y1 and y2 are depicted. The vertical direction in the drawing corresponds to the scanning direction of the recording head (main scanning direction), and the left/right direction in the drawing (the direction perpendicular to the main scanning direction) corresponds to the conveyance direction of the recording paper (sub-scanning direction).

If, as shown in FIG. 21, the nozzle rows of the same color are disposed in a spaced apart fashion on both ends of the recording head (in terms of the vertical direction) and a staggered nozzle arrangement is composed by means of these two nozzle rows, then there is a possibility that any inclination of the head (in other words, rotation within the ejection plane) will cause non-uniformity of the effective nozzle pitch (in other words, the pitch between the projected nozzles obtained by projection to an alignment in a direction perpendicular to the scanning direction of the recording head).

This variation in the nozzle pitch becomes more particularly marked, the greater the distance between the two nozzle rows of the same color (in other words, the greater the interval between the rows in the vertical direction in FIG. 21). The two rows in the vicinity of the center of the illustration in FIG. 21 (for example, the yellow nozzle rows y1 and y2) have a relatively short interval between the nozzle rows, and the variation in the effective nozzle pitch in the sub-scanning direction, Py1 and Py2, caused by any inclination (rotation) of the head is relatively small. In comparison with this, the two rows of the same color which are disposed on both ends in the upper and lower direction (for example, the cyan nozzle rows c1 and c2) have a large distance between the nozzle rows, and hence the variation in the nozzle pitch, Pc1 and Pc2, caused by any inclination (rotation) of the head becomes large. Consequently, if printing is carried out in this state, then band-shaped non-uniformities which are parallel to the main scanning direction can be perceived and can cause a great deterioration in image quality.

SUMMARY OF THE INVENTION

The present invention has been contrived in view of these circumstances, an object thereof being to provide an image forming method and an image forming apparatus whereby the visibility of banding non-uniformities can be reduced, even if the recording head is installed in an obliquely inclined fashion.

The present invention is directed to an image forming method of ejecting liquid droplets containing coloring material toward a recording medium from nozzles including main nozzles and subsidiary nozzles of nozzle rows of a recording head while causing relative movement between the recording medium and the recording head in a relative movement direction that is substantially perpendicular to a direction of alignment of the nozzles of each of the nozzle rows in such a manner that an image is formed by the coloring material on the recording medium, wherein the nozzle rows include first and second nozzle rows which have the main nozzles corresponding to a same coloring material of a particular color and at least one subsidiary nozzle row which includes the subsidiary nozzles corresponding to the same coloring material of the particular color; the first and second nozzle rows and the at least one subsidiary nozzle row are respectively arranged at different positions in terms of the relative movement direction; the at least one subsidiary nozzle row is disposed between the first and second nozzle rows; and the subsidiary nozzles are arranged in such a manner that positions of the subsidiary nozzles projected on a straight line in the direction of alignment of the nozzles of each of the nozzle rows are different from positions of the main nozzles projected on the straight line, and wherein the image forming method includes: a measurement step of measuring an amount of inclination of the recording head with respect to the relative movement direction; correction judgment step of judging whether or not correction is necessary according to the amount of inclination measured in the measurement step; and a correction step of carrying out droplet ejection from at least a portion of the subsidiary nozzles, in place of droplet ejection from at least a portion of the main nozzles when judgment is made, in the correction judgment step, that the correction is necessary, so that the correction is performed.

Furthermore, the present invention is also directed to an image forming apparatus comprising: a recording head which has nozzle rows having nozzles including main nozzles and subsidiary nozzles, the nozzle rows including first and second nozzle rows which include the main nozzles corresponding to a same coloring material of a particular color and at least one subsidiary nozzle row which includes the subsidiary nozzles corresponding to the same coloring material of the particular color, the first and second nozzle rows and the at least one subsidiary nozzle row being respectively arranged at different positions in terms of a relative movement direction that is substantially perpendicular to a direction of alignment of the nozzles of each of the nozzle rows, the at least one subsidiary nozzle row being disposed between the first and second nozzle rows, the subsidiary nozzles being arranged in such a manner that positions of the subsidiary nozzles projected on a straight line in the direction of alignment of the nozzles of each of the nozzle rows being different from positions of the main nozzles projected on the straight line; a measurement device which measures an amount of inclination of the recording head with respect to the relative movement direction; a correction judgment device which judges whether or not correction is necessary according to the amount of inclination measured by the measurement device; and a correction device which carries out droplet ejection from at least a portion of the subsidiary nozzles, in place of droplet ejection from at least a portion of the main nozzles when judgment is made, by the correction judgment device, that the correction is necessary, in such a manner that the correction is carried out, wherein the recording head ejects liquid droplets containing coloring material toward a recording medium while relative movement is caused between the recording medium and the recording head in the relative movement direction in such a manner that an image is formed by the coloring material on a recording medium.

According to the present invention, even in a situation where the positions of dots formed by droplets ejected from the main nozzles diverge from the standard positions due to inclination of the recording head, and hence there is variation in the distance between the dots created by the main nozzles, which may cause visible band-shaped non-uniformity, droplet ejection is performed by using subsidiary nozzles which are able to form dots in positions where the variation in the distance between the dots is reduced, instead of using the main nozzles, and therefore it is possible to reduce the band-shaped non-uniformity.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 14A illustrates an example of droplet ejection where the droplet ejection rate p=¼ and FIG. 14B illustrates an example of droplet ejection where the droplet ejection rate p=⅔;

DETAILED DESCRIPTION OF THE PREFERRED EMBODIMENTS

First Embodiment

Figure 1:
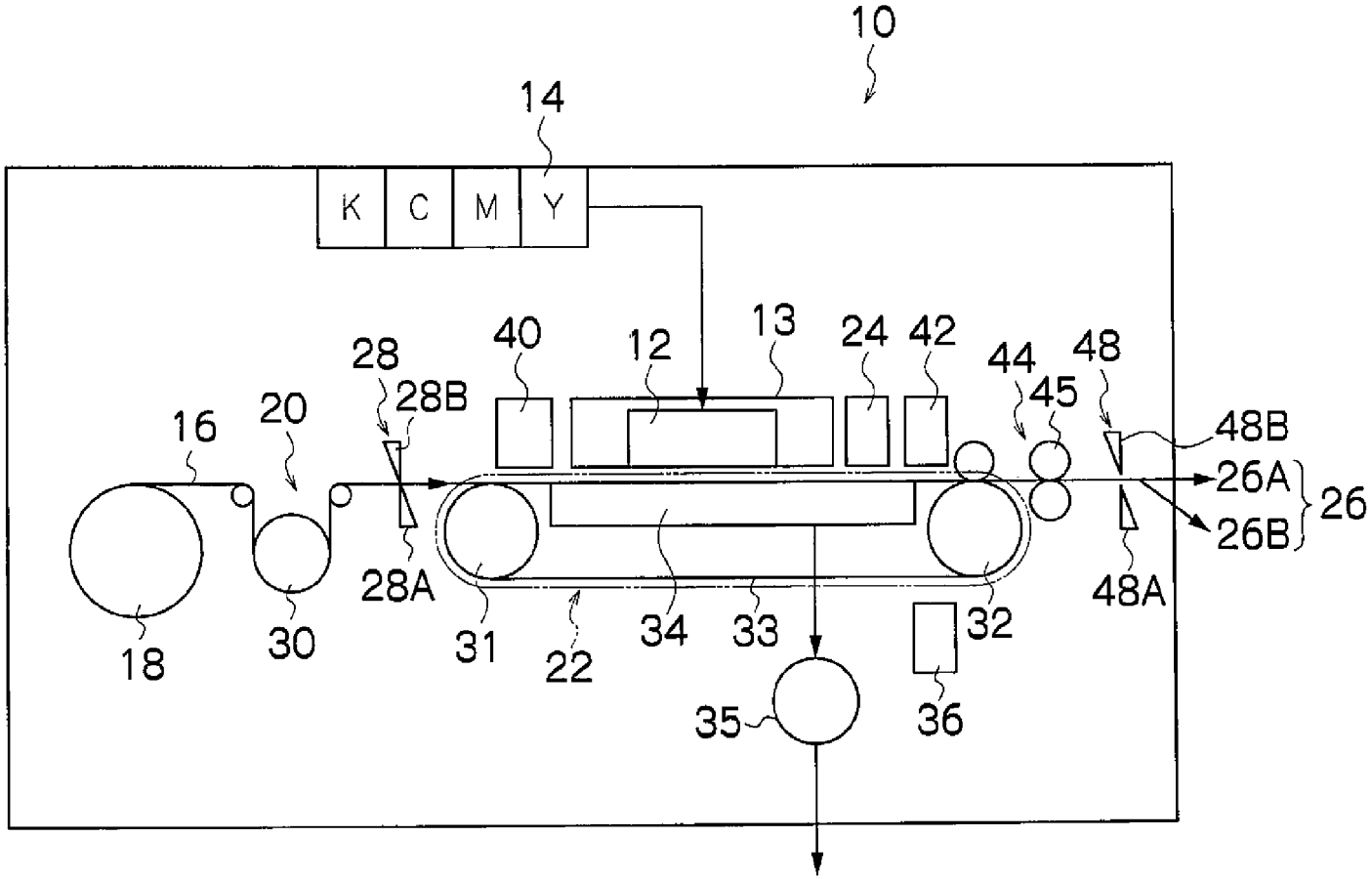
FIG. 1 is a general schematic drawing of an inkjet recording apparatus which forms one embodiment of an image forming apparatus relating to the present invention.

FIG. 1 is a general schematic drawing showing one embodiment of an inkjet recording apparatus relating to an embodiment of the present invention. As shown in FIG. 1, the inkjet recording apparatus 10 according to the present embodiment comprises: a print head 13 including a recording head 12 which ejects inks (liquids containing coloring material) of respective colors of black (K), cyan (C), magenta (M) and yellow (Y) and a scanning drive mechanism for same (not illustrated); an ink storing and loading unit 14 for storing inks of the respective colors to be supplied to the recording head 12; a paper supply unit 18 for supplying recording paper 16 which forms a recording medium; a decurling unit 20 for removing curl in the recording paper 16; a suction belt conveyance unit 22, disposed facing the nozzle surface (ink ejection surface) of the print unit 13, for conveying the recording paper 16 while keeping the recording paper 16 flat; a print determination unit 24 for reading the printed result produced by the print unit 13; and a paper output unit 26 for outputting printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. At this time, the heating temperature is preferably controlled in such a manner that the recording paper 20 has a curl in which the surface on which the print is to be made is slightly rounded in the outward direction.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 13 forms a plane.

The belt 33 has a width that is greater than the width of the recording paper 16, and a plurality of suction restrictors (not shown) are formed on the belt surface. A suction chamber 34 is disposed in a position facing the nozzle surface of the print unit 13 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction. It is also possible to use an electrostatic attraction method, instead of a suction-based attraction method.

The belt 33 in FIG. 1 is driven in the clockwise direction by the motive force of a motor 88 (not shown) being transmitted to at least one of the rollers 31 and 32, which the belt 33 is set around, and the recording paper 16 held on the belt 33 is conveyed in the paper conveyance direction (the sub-scanning direction; to the right in FIG. 1).

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 13 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The ink storing and loading unit 14 has a tank (main tank) for storing inks of the respective colors to be supplied to the recording head 12 of the print unit 13. Furthermore, the ink storing and loading unit 14 has a warning device (for example, a display device or an alarm sound generator) for warning when the remaining amount of any ink is low, and has a mechanism for preventing loading errors among the colors.

The print determination unit 24 has an image sensor (a line sensor and the like) for capturing an image of the ink-droplet deposition result of the print unit 13, and functions as a device to check for ejection defects such as clogs of the nozzles in the print unit 13 from the ink-droplet deposition results evaluated by the image sensor.

The print determination unit 24 of the present embodiment is configured with a line sensor having rows of photoelectric transducing elements with a width that is greater than the recording paper 16. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the recording head for the colors, and the ejection of the recording head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly before the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown, the paper output unit 26A for the target prints is provided with a sorter for collecting prints according to print orders.

Figure 2:
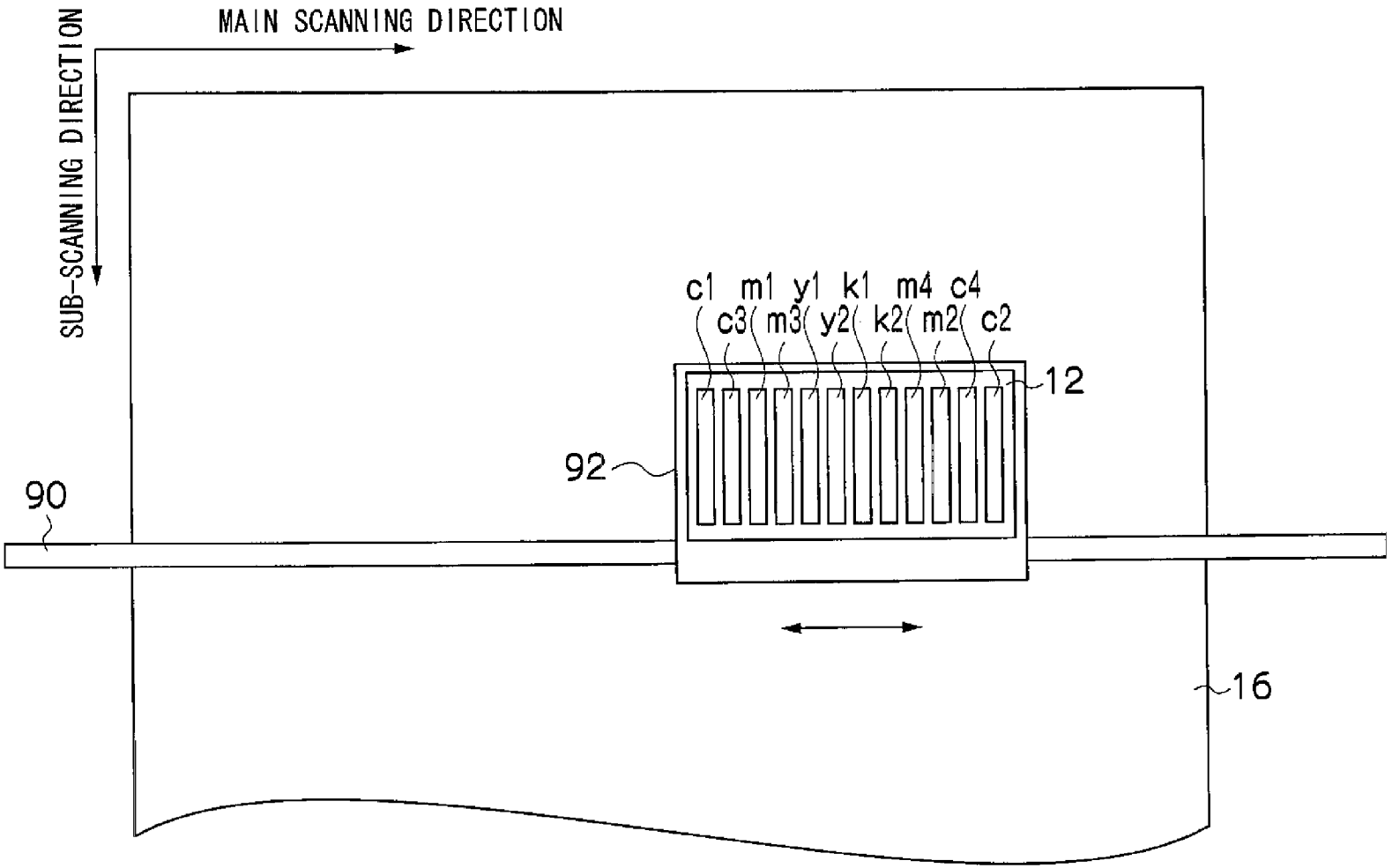
FIG. 2 is a general schematic drawing showing the composition of the peripheral area of a print unit of the inkjet recording apparatus.

FIG. 2 is a schematic composition diagram showing the periphery of the print unit in the inkjet recording apparatus 10. As shown in FIG. 2, the print unit 13 of the inkjet recording apparatus 10 comprises a carriage 92 which is capable of moving reciprocally in the breadthways direction of the recording paper 16 (main scanning direction) while being guided by means of a guide rail 90, and the recording head 12 is mounted on this carriage 92.

The recording head 12 comprises cyan nozzle rows c1 to c4 for ejecting cyan ink, magenta nozzle rows ml to m4 for ejecting magenta ink, yellow nozzle rows y1 and y2 for ejecting yellow ink, and black nozzle rows k1 and k2 for ejecting black ink; in FIG. 2, the nozzle rows are arranged in the sequence from the left to the right: c1, c3, m1, m3, y1, y2, k1, k2, m4, m2, c4, c2.

By ejecting ink droplets of the corresponding colored inks from the respective nozzles of the recording head 12 while conveying the recording paper 16 in the breadthways direction (paper conveyance direction) and moving the carriage 92 reciprocally in the main scanning direction together with the recording head 12, a desired image is recorded on the recording paper 16. Although not shown in the drawings, the recording head 12 is composed integrally with a sub tank (not shown) which corresponds to the nozzle rows of the colors, and during a recording operation, inks stored in the sub tank are supplied progressively in accordance with the ink consumption of the recording head 12. Furthermore, if the remaining amount of ink inside the sub tank becomes equal to or less than a prescribed amount, as the recording operation advances, then the carriage 92 is moved to a prescribed standby position (maintenance position). In this standby position, ink is replenished from the main tank to the sub tank, and when the sub tank is sufficiently filled with ink, the recording operation is restarted. Here, the "main tank" is equivalent to the ink storing and loading unit 14 shown in FIG. 1. It is also possible to adopt a mode in which the main tank and the sub tank are connected constantly by means of a tube, or the like, or a mode where the main tank is installed on top of the recording head.

Figure 3:
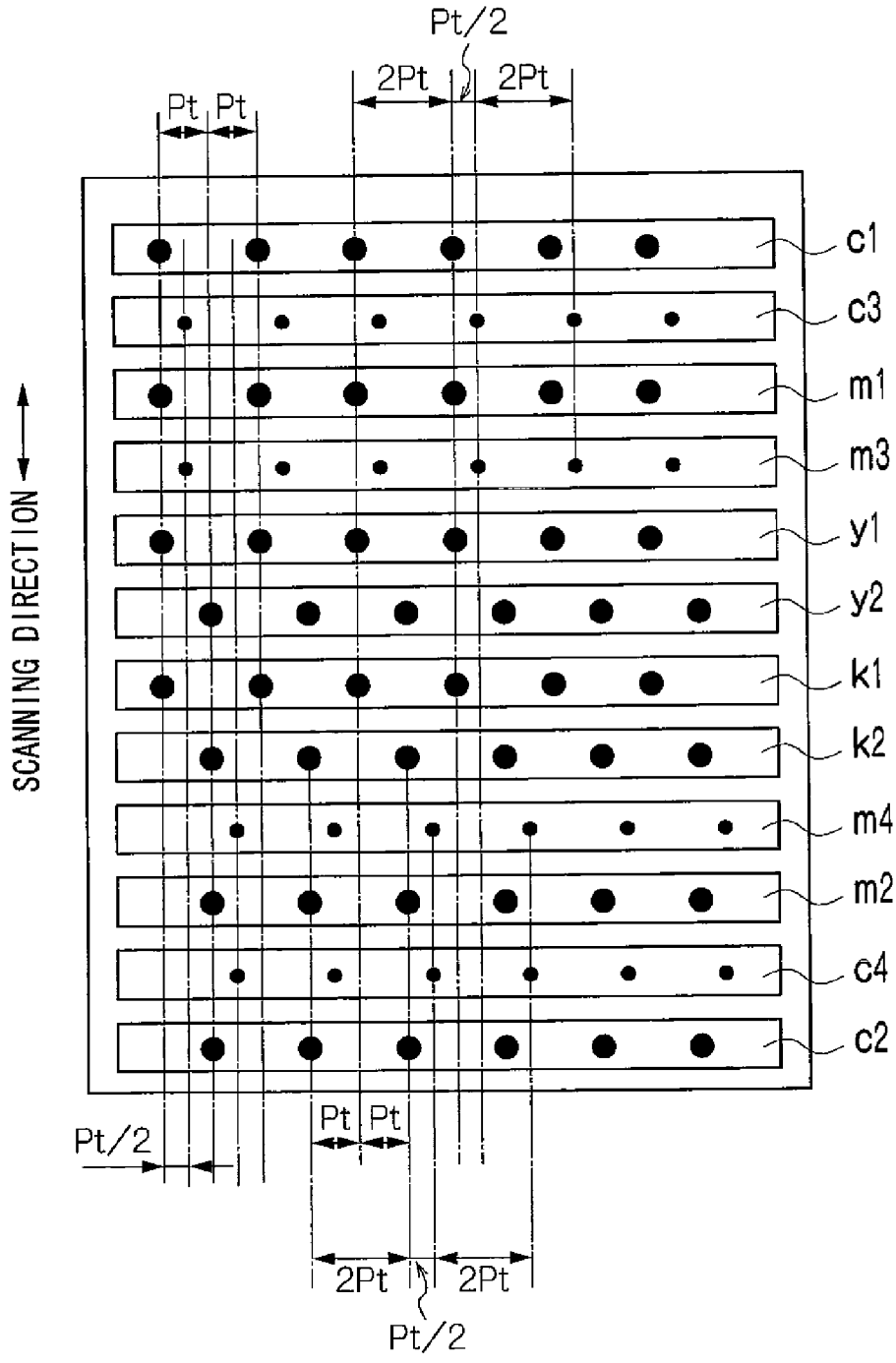
FIG. 3 is a schematic drawing showing an example of the nozzle arrangement in the recording head according to a first embodiment.

FIG. 3 is a schematic plan diagram showing an example of the arrangement of nozzle rows in the recording head 12. In FIG. 3, the vertical direction is the scanning direction of the recording head 12. This mode of the nozzle arrangement in the recording head 12 is described in detail in Japanese Patent Application Publication No. 2005-313570, which is mentioned above.

In other words, for the recording head 12 as shown in FIG. 3, with respect to cyan and magenta, in addition to the nozzle rows c1, c2, m1 and m2 (corresponding to the "first and second nozzle rows") in which main nozzles (corresponding to "main nozzles") are aligned, nozzle rows c3, c4, m3 and m4 (corresponding to the "third and fourth nozzle rows", hereinafter, be also called "sub nozzle rows") in which nozzles of smaller diameter (corresponding to "subsidiary nozzles") are arranged at uniform pitch, are also provided. The number of nozzles and the nozzle pitch in each of the nozzle rows are the same (2 Pt) in all cases. Consequently, the total number of nozzles of each of cyan and magenta in the head is twice as many as that of each of yellow and black in the head.

Looking in particular at the main nozzle rows c1, c2, m1, m2, y1, y2, k1 and k2 of the respective colors, between the main nozzle rows for ink of the same color, the positions of the nozzle rows are shifted with respect to each other by one half of the arrangement pitch of the nozzles (i.e., by Pt) in the sub-scanning direction. Furthermore, regarding the first main nozzle rows c1, m1, y1 and k1 of the respective colors, the nozzles coincide in position in terms of the sub-scanning direction between the first main nozzle rows, and it is possible to eject droplets of the inks of the four colors in a superimposed fashion onto the same position on the recording paper by means of moving (scanning) the recording head 12. Similarly, in the second main nozzle rows c2, m2, y2 and k2 of the respective colors, the nozzles coincide in position in terms of the sub-scanning direction between the second main nozzle rows, and it is possible to eject droplets of the inks of the four colors in a superimposed fashion onto the same position on the recording paper by means of scanning the recording head 12.

Looking in particular at the sub nozzle rows c3, c4, m3 and m4, the nozzle rows are shifted through one half of the nozzle arrangement pitch (i.e., through Pt) in the sub-scanning direction, between sub nozzle rows of ink of the same color. Moreover, when the main nozzle row c1 and the sub nozzle row c3 are compared with each other, and when the main nozzle row c2 and the sub nozzle row c4 are compared with each other, the nozzle rows are shifted through one quarter of the nozzle arrangement pitch (2Pt) (in other words, through Pt/2) in the sub-scanning direction, with respect to each other.

In a similar fashion, the relationship between the main nozzle row m1 and the sub nozzle row m3, and the relationship between the main nozzle row m2 and the sub nozzle row m4, are such that the positions of the nozzle rows are shifted through ¼ of the nozzle arrangement pitch in the sub-scanning direction, between rows.

Taking account of the positional relationships between the nozzles of the four nozzle rows relating to each of cyan and magenta, and the positional relationships between the nozzles of the two nozzle rows relating to each of yellow and black, recording can be carried out at a greater resolution for cyan and magenta than for yellow and black.

Furthermore, the volume of the ink droplets ejected from the nozzles of the sub nozzle rows is smaller than the volume of the ink droplets ejected from the nozzles of the main nozzle rows. The sub nozzle rows c3, c4, m3 and m4 which are appended for cyan and magenta are used in the high-resolution recording mode, and furthermore, they are also used in order to suppress banding caused by inclination of the head. The details of this are described hereinafter.

The inkjet recording apparatus 10 according to the present embodiment which has the composition described above, has a "normal recording mode" which emphasizes printing speed (this corresponds to a "first recording mode"), and a "high-resolution recording mode" which emphasizes print quality and has a higher resolution (this corresponds to a "second recording mode"). The device for switching the recording mode may adopt a composition in which the mode is switched by means of a selection operation performed by the user using an operating device (not illustrated; a user interface constituted by an input apparatus, typically, operating buttons, a keyboard or touch panel, a mouse, or the like), or it may adopt a composition in which the mode is switched automatically by means of a control program.

If the high-resolution recording mode is selected, then in each case of cyan and magenta, all of the nozzle rows of the four rows including the sub nozzle rows are used. If the normal recording mode is selected, on the other hand, then, in principle, the sub nozzle rows are not used and only the main nozzle rows are used for cyan and magenta. However, when carrying out correction of image degradation due to inclination of the head (by substitution of the nozzles used), as described hereinafter, the sub nozzle rows are used.

Although a configuration with the four standard colors, K, C, M and Y, is exemplified in the present embodiment, the combinations of the ink colors and the number of colors are not limited to these, and light and/or dark inks or special colors can be added as required. For example, a configuration is possible in which the recording head further includes nozzle rows of ejecting light-colored inks such as light cyan and light magenta.

Figure 4:
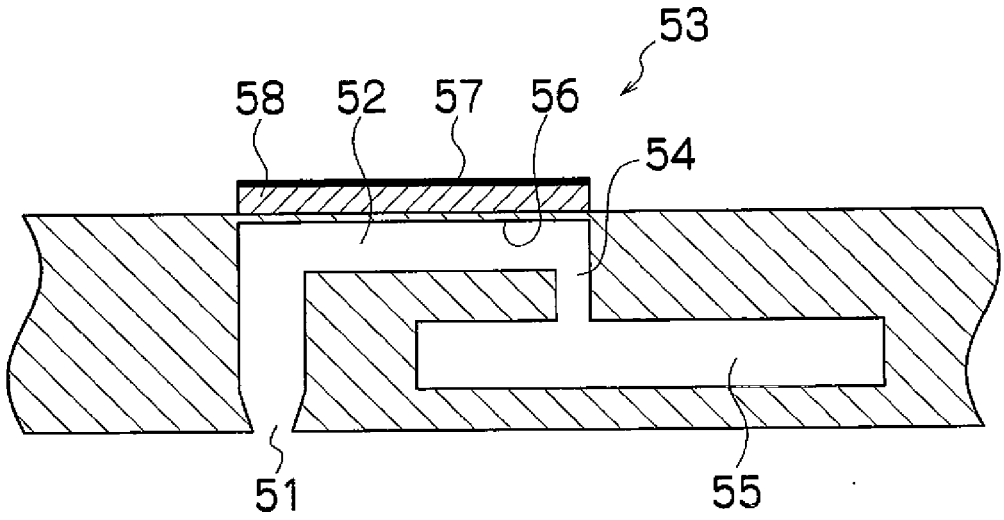
FIG. 4 is a cross-sectional diagram showing the principal composition of a recording head.

FIG. 4 is a cross-sectional diagram which shows the three-dimensional composition of the liquid droplet ejection element for one channel which forms a recording element unit (the ink chamber unit 53 corresponding to one nozzle 51) in the recording head 12.

As shown in FIG. 4, pressure chambers 52 are connected to a common channel 55 through supply ports 54. The common channel 55 is connected to an ink tank (sub tank or main tank), which is a base tank that supplies ink, and the ink supplied from the ink tank is delivered through the common flow channel 55 to the pressure chambers 52.

Each actuator 58 provided with an individual electrode 57 is bonded to a pressure plate (a diaphragm that also serves as a common electrode) 56 which forms the surface of one portion (in FIG. 4, the ceiling) of the pressure chambers 52. When a drive voltage is applied to the individual electrode 57 and the common electrode, the corresponding actuator 58 deforms, thereby changing the volume of the pressure chamber 52. This causes a pressure change which results in ink being ejected from the nozzle 51. For the actuator 58, it is possible to adopt a piezoelectric element using a piezoelectric body, such as lead zirconate titanate, barium titanate, or the like. When the displacement of the actuator 58 returns to its original position after ejecting ink, the pressure chamber 55 is replenished with new ink from the common flow channel 54, via the supply port 52.

By controlling the driving of the actuators 58 corresponding to the nozzles 51 in accordance with the dot data generated from the input image, it is possible to eject ink droplets from the nozzles 51. By controlling the ink ejection timing from the nozzles 51 in accordance with the speed of conveyance of the recording paper 16 while conveying the recording paper 16 in the sub-scanning direction at a uniform speed, it is possible to record a desired image onto the recording paper 16.

In implementing the present embodiment, the arrangement of the nozzles is not limited to that of the example illustrated. Moreover a method is employed in the present embodiment where ink droplets are ejected by means of the deformation of the actuators 58, which are typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Furthermore, the planar shape of the pressure chamber 52 is not limited in particular, and various modes are possible in which the planar shape is a quadrilateral shape (square shape, diamond shape, rectangular shape, or the like), a pentagonal shape, a hexagonal shape, or other polygonal shape, or a circular shape, elliptical shape, or the like.

Figure 5:
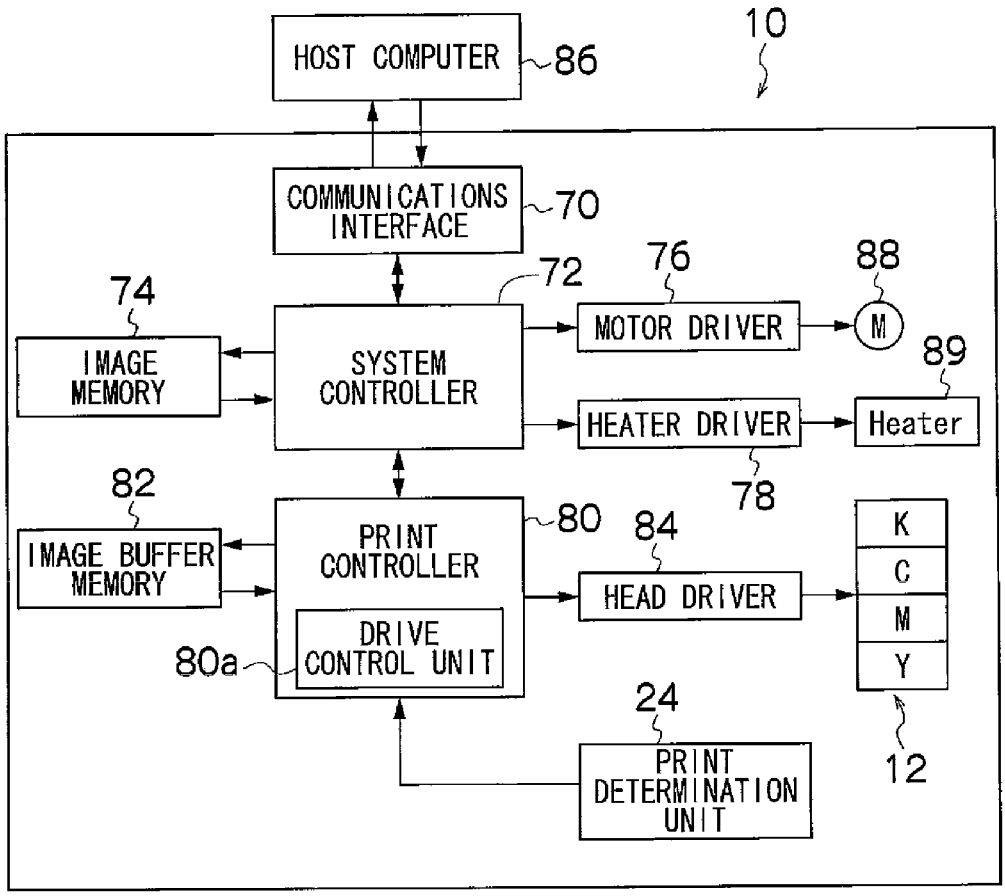
FIG. 5 is a principal block diagram showing a system composition of the inkjet recording apparatus.

FIG. 5 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit which functions as an image input device for receiving image data sent from a host computer 86. A serial interface and a parallel interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 functions as a control device which controls the various sections, such as the communications interface 70, the image memory 74, the motor driver 76, the heater driver 78, and the like, as well as functioning as a computational device which carries out calculations of various kinds. In other words, the system controller 72 is constituted by a central processing unit (CPU) and peripheral circuits thereof, and the like, and in addition to controlling communications with the host computer 86 and controlling reading and writing from and to the image memory 74, and the like, it also generates control signals for controlling the head scanning drive mechanism, the motor 88 of the recording medium conveyance system and the heater 89. The image memory 74 is also used as a calculation work space for the CPU of the system controller 72.

The motor driver (drive circuit) 76 drives the motor 88 of various sections in accordance with commands from the system controller 72. The heater driver (drive circuit) 78 drives the heater 89 of the post-drying unit 42 or other units in accordance with commands from the system controller 72.

The print controller 80 is a control unit comprising a drive control unit 80*a* having a signal processing function for per-forming various treatment processes, corrections, and the like, in accordance with the control implemented by the system controller 72, in order to generate a signal for controlling droplet ejection, from the image data (multiple-value input image data) in the image memory 74, and it functions as an ejection drive control device which supplies the ejection data (dot data) thus generated to the head driver 84.

Required signal processing is carried out in the print controller 80, and the ejection amount and the ejection timing of the ink liquid from the recording head 12 are controlled via the head driver 84, on the basis of the print data. By this means, desired dot sizes and dot positions can be achieved.

In other words, the drive control unit 80*a* provided in the print controller 80 corresponds to the "correction device" of the present invention. The correction processing and ejection control described below are carried out by the drive control unit 80*a*.

The print controller 80 is provided with the image buffer memory 82; and image data, parameters, and other data are temporarily stored in the image buffer memory 82 when image data is processed in the print controller 80. The aspect shown in FIG. 5 is one in which the image buffer memory 82 accompanies the print controller 80; however, the image memory 74 may also serve as the image buffer memory 82. Also possible is an aspect in which the print controller 80 and the system controller 72 are integrated to form a single processor.

A schematic processing flow from image input to printout shows that the image data to be printed is externally inputted through the communication interface 70, and is stored in the image memory 74. In this stage, for example, the RGB multiple-value input image data is stored in the image memory 74.

In this inkjet recording apparatus 10, an image which appears to have continuous tonal graduations to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 74 is sent to the print controller 80 through the system controller 72, and is converted to the dot data (droplet ejection arrangement data) for each ink color by a halftoning technique, using dithering, error diffusion, or the like.

In other words, the print controller 80 performs processing for converting the inputted RGB image data into dot data for four colors, K, C, M and Y The dot data generated by the print controller 80 is stored in the image buffer memory 82. This dot data of the respective colors is converted into CMYK droplet ejection data for ejecting inks from the nozzles 51 of the recording head 12, thereby establishing the ink ejection data to be printed.

The head driver 84 generates drive signals for driving the actuators 58 (see FIG. 4) of the recording head 12 on the basis of the dot arrangement data supplied from the print controller 80, and it supplies the drive signals thus generated to the actuators 58. A feedback control system for maintaining constant drive conditions for the recording head 12 may be included in the head driver 84.

By controlling ink ejection from the nozzles in synchronization with the conveyance speed of the recording paper 16 forming the recording medium and the scanning (moving) speed of the recording head 12, an image is formed on the recording paper 16.

The print determination unit 24 reads in a test pattern recorded by the recording head 12, and it performs prescribed signal processing, and the like, in order to determine the ink ejection status of the recording head 12 (the presence/absence of ejection, the dot sizes, dot positions, and the like). The print determination unit 24 supplies the determination results to the print controller 80. According to requirements, the print controller 80 implements various corrections with respect to the recording head 12, on the basis of the information obtained from the print determination unit 24, and implements control for carrying out cleaning operations (nozzle restoring operations), such as preliminary ejection, suctioning, or wiping, as and when necessary.

A combination of the print determination unit 24 and the system controller 72 according to the present embodiment functions as a "measurement device" which measures the amount of inclination of the head. Furthermore, the system controller 72 or a combination of the system controller 72 and the print controller 80 according to the present embodiment functions as the "correction judgment device" and the "correction device".

Correction Method of Inclination (Rotation) of Head

In the inkjet recording apparatus 10 relating to the present embodiment, if it is determined that the recording head 12 is installed in an inclined fashion, then in a normal recording mode, ejected dots from the main nozzle rows (c1, c2) are substituted with dots caused by the ejection from the sub nozzle rows (c3, c4), and hence it is possible to reduce the visibility of banding caused by inclination of the head as described above.

The following description relates to correction in relation to cyan nozzles, which are disposed in the outermost positions of the nozzle rows in the recording head 12, but similar correction is also carried out in relation to the magenta nozzles, which are disposed to the inside of these.

Figure 6:
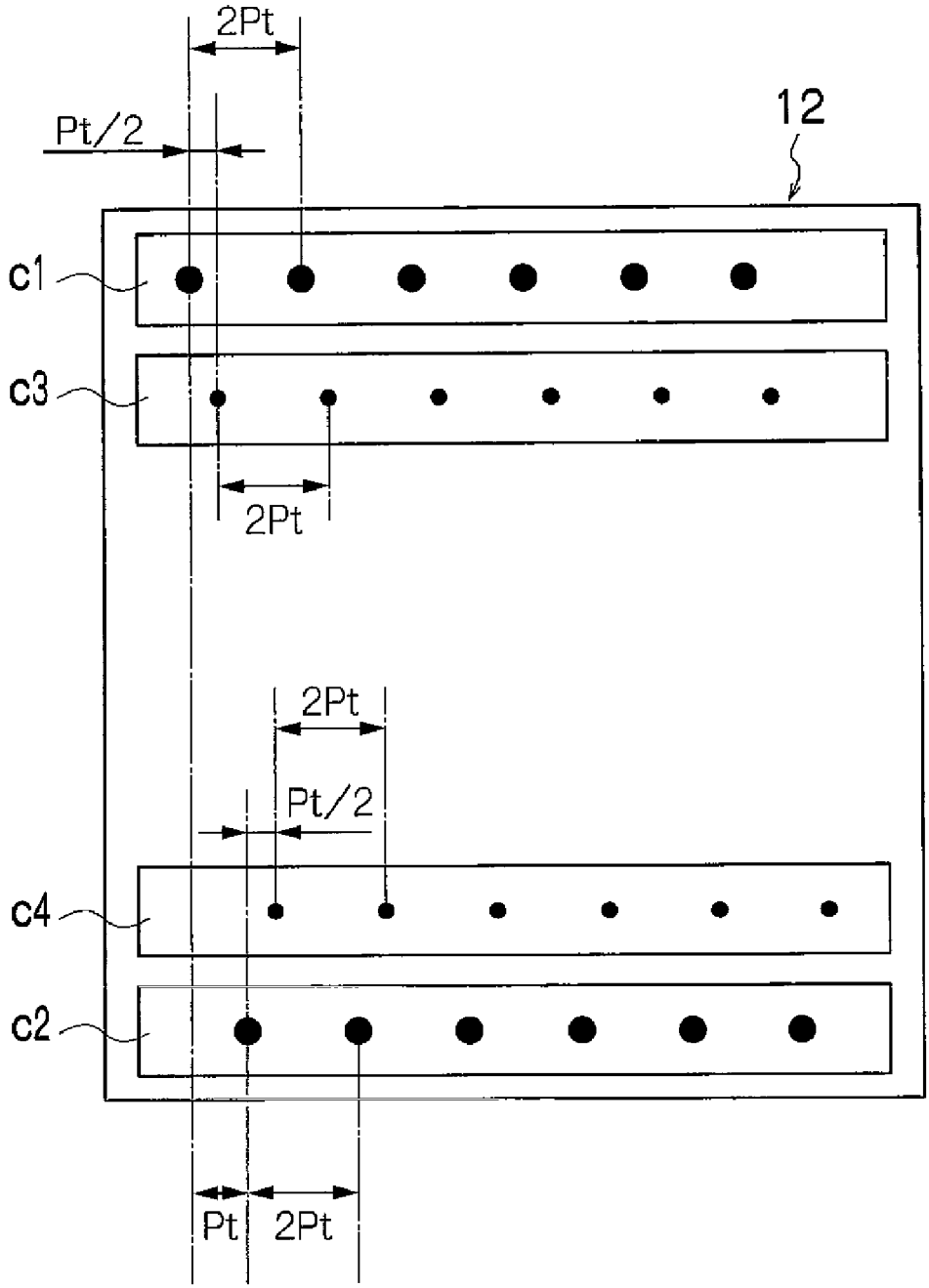
FIG. 6 is a drawing showing the arrangement of cyan nozzles in the recording head according to the first embodiment.

FIG. 6 is a schematic drawing of the cyan nozzle rows. As shown in FIG. 6, the effective nozzle pitch created by the staggered arrangement of the main nozzle rows c1 and c2 (the standard nozzle pitch in the sub-scanning direction) is Pt. In each of the nozzle rows, the pitch between nozzles in the sub-scanning direction is 2Pt; and the effective nozzle pitch of the staggered arrangement including the four rows, c1 to c4, is Pt/2. In other words, the pitch of the nozzles of the main nozzles when the nozzles are projected to a straight line in the nozzle alignment direction (here, the sub-scanning direction) is Pt, and the positions of the nozzles of the sub nozzle rows c3 and c4 (sub nozzles) when the nozzles are projected to a straight line in the nozzle alignment direction (here, the sub-scanning direction) are interposed between the positions of the main nozzles, in such a manner that the overall nozzle pitch in the sub-scanning direction is Pt/2.

Below, consideration is given to the variation of the nozzle pitch in a case where the whole head having a nozzle arrangement of this kind is installed in a rotated (inclined) fashion within the plane parallel to the paper surface.

Calculation of Amount of Inclination of the Head

Figure 7:
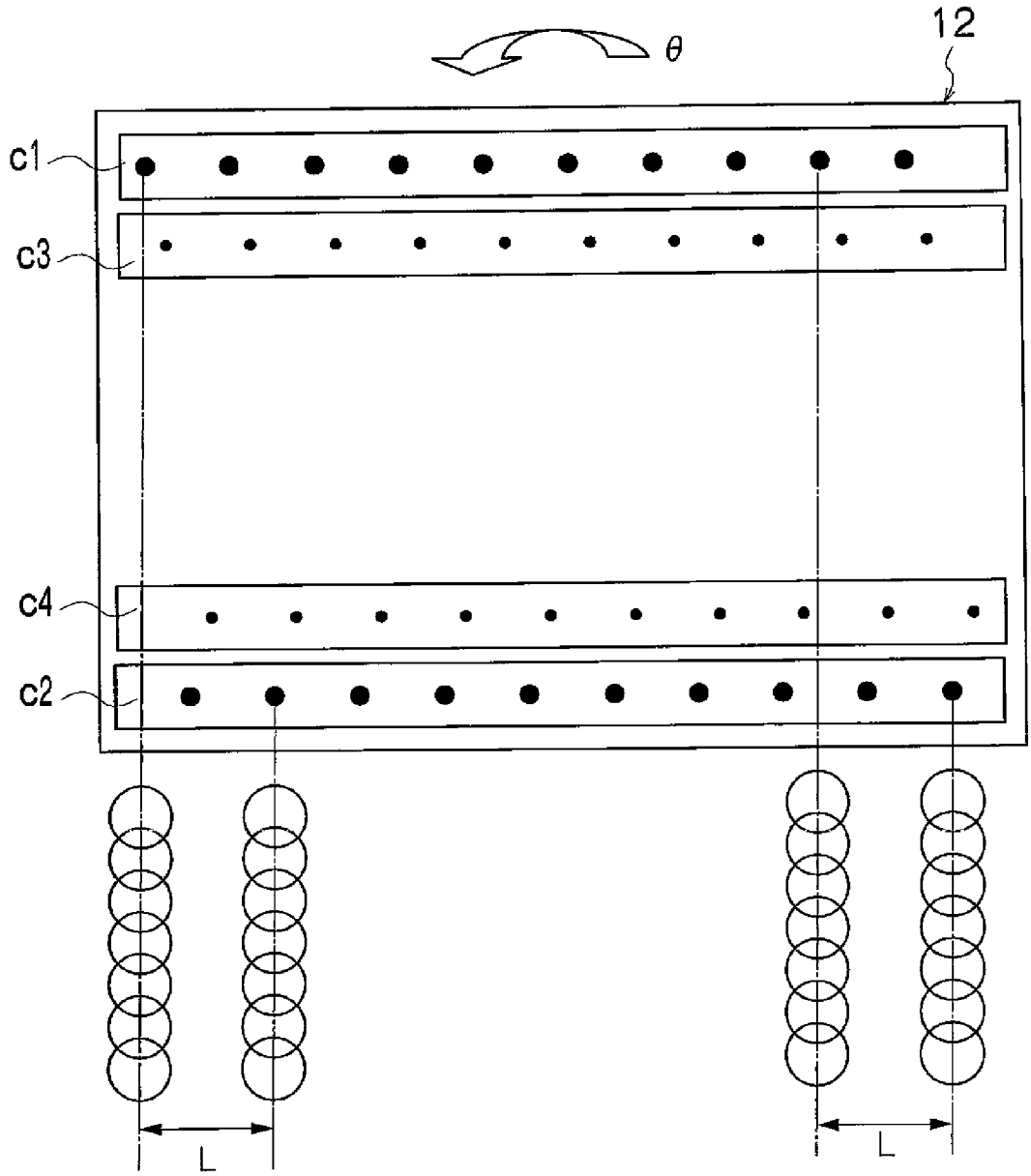
FIG. 7 is an illustrative diagram for describing an example of the calculation of amount of inclination of the head.

The straightforward and appropriate method of calculating the amount of inclination (amount of rotation) of the head is desirably based on reading out a test pattern image. As shown in FIG. 7, liquid droplets are ejected from a particular group of nozzles, of the main nozzles, to form dot lines (dot rows) on the recording medium, and the interval L between dots is read in from these dot rows to determine the difference ΔL with respect to the reference value L0 (i.e., L−L0=ΔL).

If this difference ΔL exceeds the prescribed judgment reference value, then correction is carried out (ejection nozzles are changed) in the manner described in the following section.

It is appropriate that the group of nozzles used to evaluate the interval L should be a group of nozzles from which the dots ejected do not overlap with each other, as shown in FIG. 7, since this makes it easier to read out the interval. An appropriate method of reading out the interval L is one where the test pattern image is read out by means of the print determination unit 24 (see FIG. 1) or a scanner, or the like, and the reading results are subjected to suitable binarization processing, whereupon the center of each of the lines is determined, and the difference between same is found.

Furthermore, for the nozzles, there may be error in the ejection direction due to non-uniformity of the lyophobic properties about the perimeter of the nozzle surface, adherence of dirt, or the like. In this case, desirably, the interval between dot lines is measured in a plurality of locations as shown in FIG. 7 and the average value of this interval is taken to be L, or alternatively, the interval L is desirably determined by means of the method proposed by the inventor in Japanese Patent Application Publication No. 2007-030363 (a method which distinguishes between error caused by deviation in the installation of the head and error which is intrinsic to the nozzles).

Premise of Sequence for Judging Whether or Not to Carry Out Correction

"The prescribed judgment reference value" which forms a reference for judging whether or not to carry out correction (by changing the ejection nozzles) is determined in the following manner.

Figure 8:
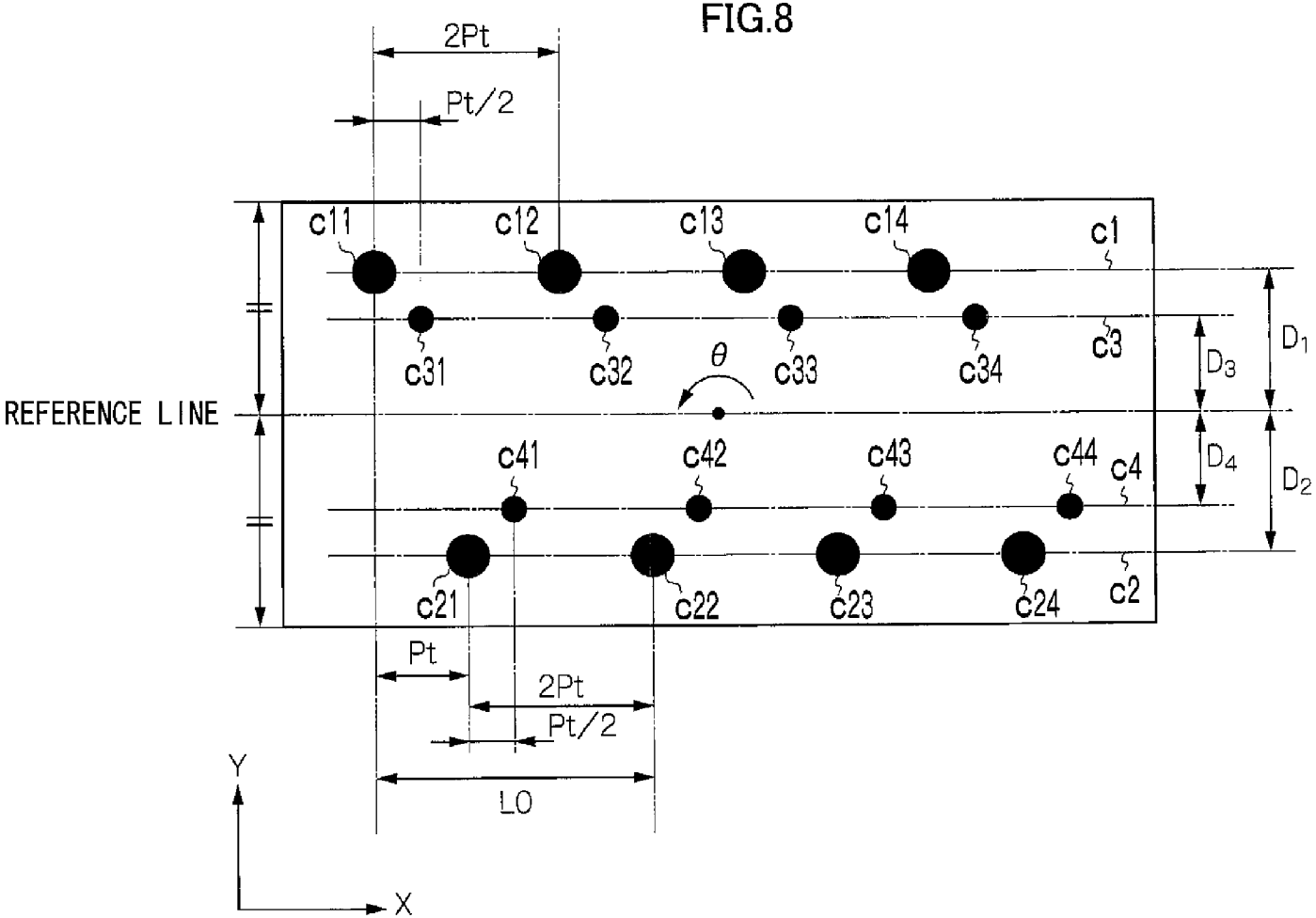
FIG. 8 is a general schematic drawing showing the arrangement of cyan nozzles in the recording head according to the first embodiment.

Firstly, as shown in FIG. 8, the lengths of the respective parts are defined. The reference line is the center line with respect to the Y direction of the recording head (the main scanning direction in the case of a serial type head).

As shown in FIG. 8, if the X and Y directions are taken as reference, and the angle of rotation about the center of the head is taken as θ (where rotation in the "counterclockwise" direction indicated by the arrow in FIG. 8 is taken to be positive rotation), then the relative positional errors in the X direction of the nozzles in each of the rows are expressed as indicated below (the relative positional errors in the four rows c1 to c4 are expressed respectively as $\Delta c_1$ to $\Delta c_4$).

$$\Delta c_1=-D_1 \sin\theta,\ \Delta c_2=+D_2 \sin\theta \qquad \text{Formula 1}$$

$$\Delta c_3=-D_3 \sin\theta,\ \Delta c_4=+D_4 \sin\theta \qquad \text{Formula 2}$$

In this case, ΔL is given by the following.

$$\Delta L=L-L0=\{(3Pt+\Delta c_2)-(\Delta c_1)\}-3Pt=(D_1+D_2)\sin\theta \qquad \text{Formula 3}$$

From the viewpoint of reducing banding, it is desirable that the nozzle pitch should be as uniform as possible.

(1) If the Amount of Rotation of the Head θ>0, (ΔL>0):

In this case, it is judged whether or not to replace the ejection from the nozzle row c1 with the ejection from the nozzle row c3.

If the $i^{th}$ nozzles in the nozzle rows c1 to c4 are denoted respectively as "c1*i*" to "c4*i*", and if the following definitions are used:

position of c12 in X direction)−(intermediate value of positions of c21 and c22 in X direction)=S1; and (position of c32 in X direction)−(intermediate value of positions of c21 and c22 in X direction)=S2, then the values S1 and S2 in the equations above can be expressed respectively by the following formulas.

$$S1=(Pt+\Delta c_1)-(Pt+\Delta c_2)=\Delta c_1-\Delta c_2=-(D_1+D_2)\sin\theta=-\Delta L \qquad \text{Formula 4}$$

$$\begin{aligned} S2 &= \left(\frac{3}{2}Pt+\Delta c_3\right)-(Pt+\Delta c_2) \\ &= \frac{1}{2}Pt+\Delta c_3-\Delta c_2 \\ &= \frac{1}{2}Pt-(D_2+D_3)\sin\theta \\ &= \frac{1}{2}Pt-\frac{D_2+D_3}{D_1+D_2}\Delta L \end{aligned} \qquad \text{Formula 5}$$

Figure 9:
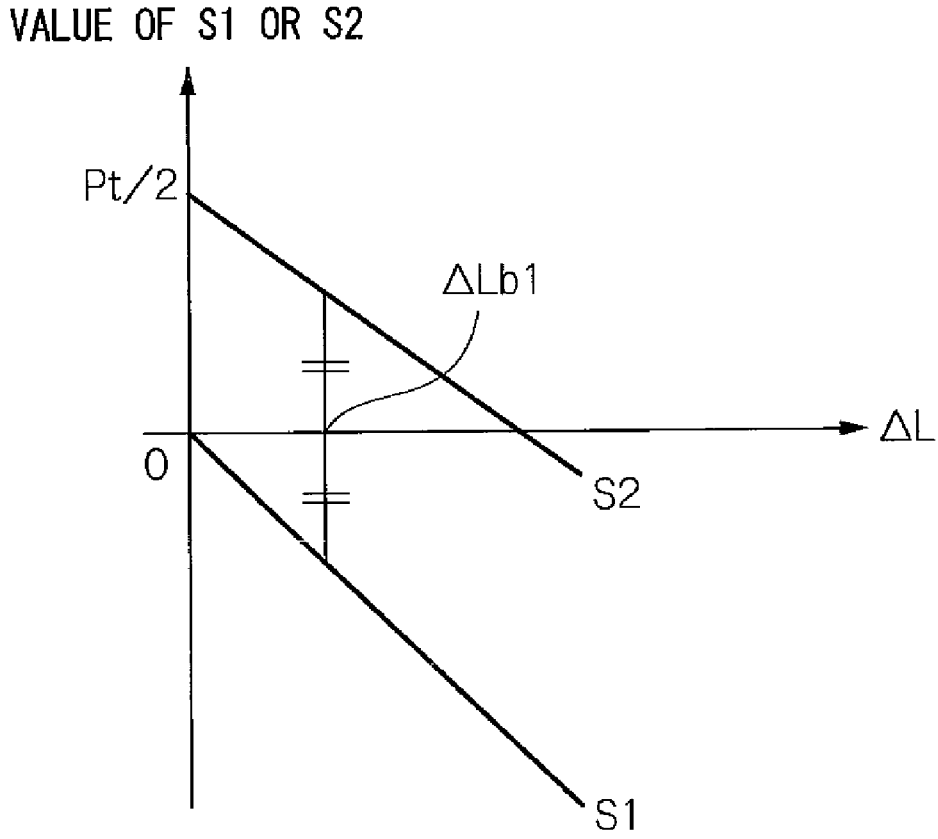
FIG. 9 is a graph for describing a method of calculating a reference for judging whether or not to carry out correction.

If these relationships are depicted in the form of a graph, then the illustration in FIG. 9 is obtained.

From the viewpoint of achieving a uniform nozzle pitch, it is desirable to select one having a smaller absolute value, from the absolute values of S1 and S2, namely, |S1| and |S2|.

Consequently, if the value of ΔL satisfying "−S1=S2" is taken to be ΔLb1 (see graph in FIG. 9), then the value of ΔLb1 is given by the following.

$$\begin{aligned} \Delta Lb1 &= \frac{1}{2}Pt-\frac{D_2+D_3}{D_1+D_2}\Delta Lb1 \\ &= \frac{1}{2}\times\frac{D_1+D_2}{D_1+D_3+2D_2}Pt \end{aligned} \qquad \text{Formula 6}$$

Consequently, (a) if "ΔL≦ΔLb1" is satisfied, then correction is not carried out; and (b) if "ΔL>ΔLb1" is satisfied, then (a portion of) the dots relating to the nozzle row c1 are replaced with the dots relating to ejection by the nozzle row c3.

(2) If the Amount of Rotation of the Head θ<0, (ΔL<0):

In this case, it is judged whether or not to replace ejection by nozzles of the nozzle row c2 with ejection by nozzles of the nozzle row c4.

If S3 and S4 are defined as:

(position of c21 in X direction)−(intermediate value of positions of c11 and c12 in X direction)=S3; and (position of c41 in X direction)−(intermediate value of positions of c11 and c12 in X direction)=S4, then S3 and S4 represented by the equations above are expressed respectively by the following formulas.

$$S3=(Pt+\Delta c_2)-(Pt+\Delta c_1)=\Delta c_2-\Delta c_1=(D_1+D_2)\sin\theta=\Delta L \qquad \text{Formula 7}$$

$$\begin{aligned} S4 &= \left(\frac{3}{2}Pt+\Delta c_4\right)-(Pt+\Delta c_1) \\ &= \frac{1}{2}Pt+\Delta c_4-\Delta c_1 \\ &= \frac{1}{2}Pt+(D_1+D_4)\sin\theta \\ &= \frac{1}{2}Pt+\frac{D_1+D_4}{D_1+D_2}\Delta L \end{aligned} \qquad \text{Formula 8}$$

Figure 10:
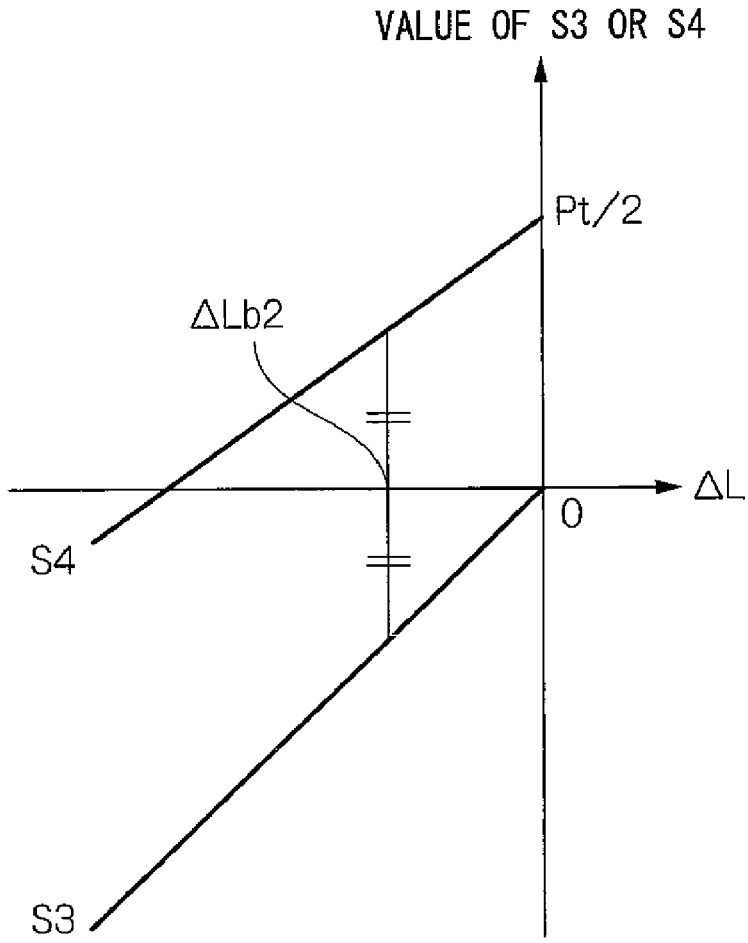
FIG. 10 is a graph for describing a method of calculating a reference for judging whether or not to carry out the correction.

If these relationships are depicted in the form of a graph, then the illustration in FIG. 10 is obtained.

Similarly to the case (1) described above, if the value of ΔL satisfying "−S3=S4" is taken to be ΔLb2 (see the graph in FIG. 10), then the value of ΔLb2 is given by the following.

$$-\Delta Lb2 = \frac{1}{2}Pt + \frac{D_1 + D_4}{D_1 + D_2}\Delta Lb2 \qquad \text{Formula 9}$$

$$\Delta Lb2 = -\frac{1}{2} \times \frac{D_1 + D_2}{D_2 + D_4 + 2D_1}Pt$$

Consequently, (c) if "ΔL≧ΔLb2" is satisfied, then correction is not carried out; and (d) if "ΔL<ΔLb2" is satisfied, then dots created by c4 are substituted for (a portion of) the dots created by c2.

Summarizing the situations (a) to (d) relating to cases (1) and (2) described above, the following relationships are obtained.

[1] ΔL<ΔLb2: dots created by c4 are substituted for (a portion of) the dots created by c2

[2] ΔLb2≦ΔL≦ΔLb1: no correction

[3] ΔLb1<ΔL: dots created by c3 are substituted for (a portion of) the dots created by c1

In FIG. 8, the distance in the X direction between the main nozzles and the corrective nozzles is (½)×Pt, but it does not necessarily have to be this value. If the distance in the X direction between the nozzles in c1 and the nozzles in c3 is taken to be k3×Pt, and the distance in the X direction between the nozzles in c2 and the nozzles in c4 is taken to be k4×Pt, then ΔLb1 and ΔLb2 are expressed respectively by the following.

$$\Delta Lb1 = k3 \times \frac{D_1 + D_2}{D_1 + D_3 + 2D_2}Pt, \qquad \text{Formula 10}$$

$$\Delta Lb2 = -k4 \times \frac{D_1 + D_2}{D_2 + D_4 + 2D_1}Pt$$

Based upon this relationships, it is possible to employ the conditions stated in [1] to [3] above.

By evaluating the amount of inclination of the head and determining the ejection nozzles in accordance with the judgments in [1] to [3], it is possible to reduce the interval between the dot rows formed on the recording paper; and therefore it is possible to form an image in which banding is not readily visible.

Furthermore, in the case of [1] (droplet ejection by the nozzle row which is to be replaced with droplet ejection by a sub nozzle row, as a result of correction) for example, the nozzle row c2 is called the "corrected nozzle row" and the nozzle row c4 (the nozzle row which carries out droplet ejection instead of the main nozzle row) is called the "corrective nozzle row".

Method of Ejecting Droplets for Corrective Dots

Figure 11A:
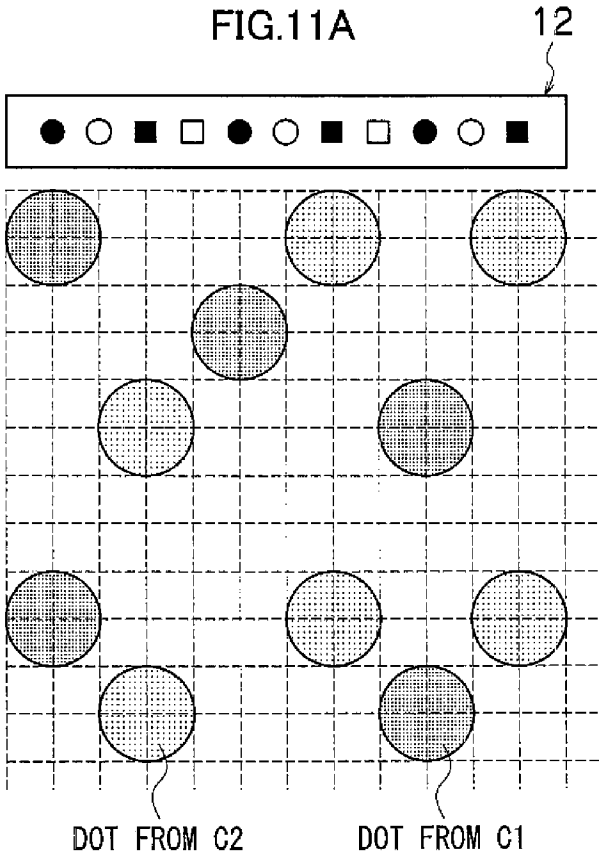
FIGS. 11A and 11B are diagrams showing examples of droplet ejection in a case where correctional processing is not implemented according to the present embodiment.
Figure 11B:
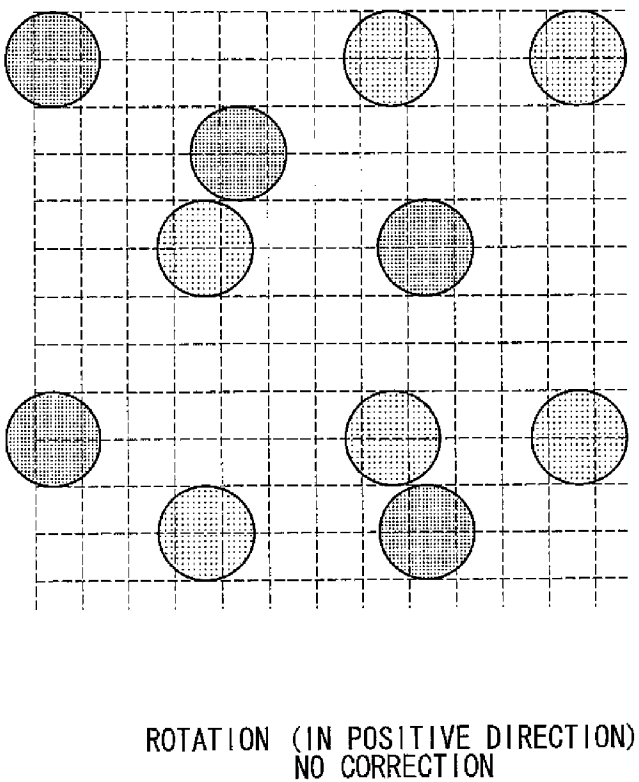

Next, an example of ejecting droplets to form corrective dots will be described. FIG. 11A shows an example of droplet ejection in a case where there is no rotation of the head (where the head is installed in an ideal position and the droplets land on ideal positions), and FIG. 11B shows an example of droplet ejection in a case where the head is rotated (in the positive direction) and correction is not implemented. In FIG. 11A, the nozzles belonging to the nozzle rows c1, c2, c3 and c4 are represented respectively by the symbols, "●", "■", "○", and "□". The actual arrangement of the nozzle rows is as shown in FIG. 8, but in FIG. 11A, the nozzles are depicted in the same position in terms of the Y direction, in order to make the diagram easier to understand.

Here, the droplet volume of the main dots (dots ejected from the nozzles of c1 and c2) is taken to be 5 picoliters (pl) and the droplet volume of the corrective dots (the dots ejected from the nozzles of c3 and c4) is taken to be 2 pl. Furthermore, the minimum pitch between dots (the distance between the cells indicated by the dotted lines in FIGS. 11A and 11B) is 10.5 μm. However, the dot diameter indicated in FIGS. 11A and 11B is depicted to be smaller than the actual size (in actual practice, the diameter of a 5 pl dot is 42 μm and the diameter of a 2 pl dot is 31 μm, approximately). In practice, correction is carried out within the density range described below, but here, the number of dots is reduced in the illustrations in order to make it easier to understand.

Figure 12:
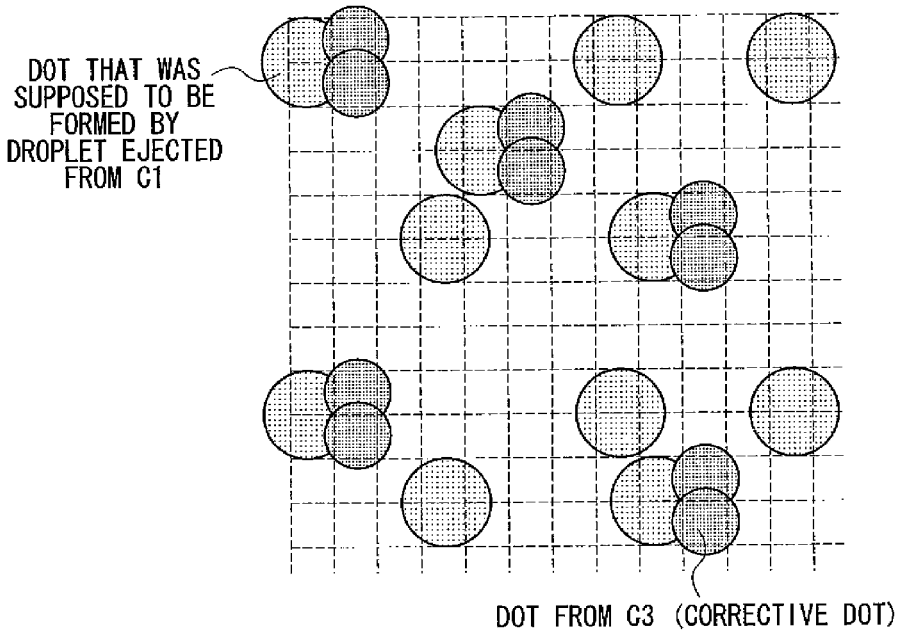
FIG. 12 is a diagram showing an example of droplet ejection in a case where the correctional processing is implemented according to the present embodiment.

FIG. 12 is an example of droplet ejection in a case where correction is carried out under the circumstances shown in FIG. 11B. Here, one dot of 5 pl from a nozzle belonging to the nozzle row c1 is substituted with two dots of 2 pl from a nozzle belonging to the nozzle row c3.

In this case, taking the liquid droplet volume of one main dot to be V1 (pl), the surface area of same to be S1 ($\mu m^2$), the liquid droplet volume of one corrective dot to be V2 (pl), and the surface area of same to be S2 ($\mu m^2$), and considering a case where N1 main dots are replaced (corrected) with N2 corrective dots (where N1 and N2 are positive integers), then it is desirable that the number of corrective dots, N2, should satisfy the below-described Condition 1, Condition 2 and Condition 3.

With respect to the number of dots: N2>N1 — Condition 1

With respect to the overall volume: $N2 \times V2 < N1 \times V1$ — Condition 2

With respect to the overall surface area: $N2 \times S2 > N1 \times S1$ — Condition 3

Figure 13:
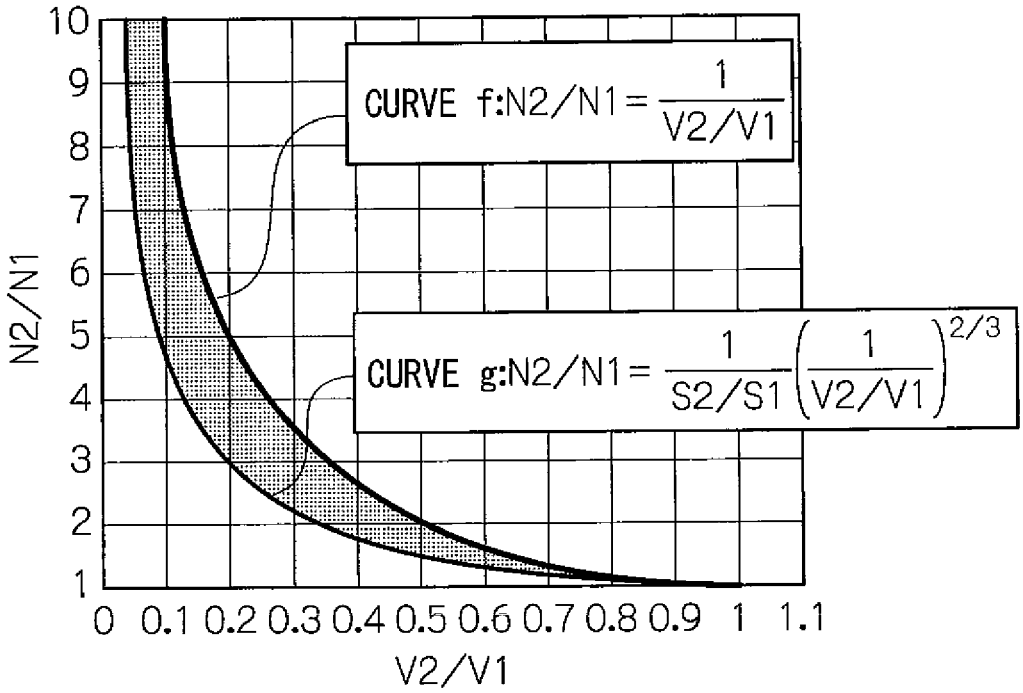
FIG. 13 is a graph showing a relationship between the liquid droplet volume V1 and the number of nozzles, N1, of the corrected nozzles, and the liquid droplet volume V2 and the number of nozzles, N2, of the corrective nozzles.

It is known that, if the main dots and the corrective dots are formed by using the same ink, then the surface area of the dots will be directly proportional to the ⅔ (two-thirds) power of the droplet volume. If these conditions are satisfied, then when the ratio V2/V1 of the liquid droplet volumes of one dot is plotted on the X axis and the ratio N2/N1 of the number of dots is plotted on the Y axis, the range which satisfies both of the conditions [2] and [3] above is the shaded region which is enclosed between the curves f and g in FIG. 13. Desirably, N2/N1 is determined from this region. For example, if V1=8 pl and V2=1.5 pl, then if N1=1, it is desirable that N2 should be N2=4 or 5. In FIG. 13, if V2/V1=1 (in other words, if the main dots and the corrective dots have equal volumes), then the desirable region corresponds to N2/N1=1.

Switching Correction in Accordance with Density

There are two possible modes for designing the corrective nozzles: (1) a mode where the nozzles are designed in such a manner that liquid droplets of substantially the same volume as those from the main nozzles are ejected and (2) a mode where the nozzles are designed in such a manner liquid droplets which are smaller than those from the main nozzles are ejected.

When the design indicated in the former mode (1) is adopted (namely, a design whereby liquid droplets of substantially the same volume as those from the main nozzles are ejected from the corrective nozzles), then the dot data relating to the corrected nozzle row is shifted directly to the corrective nozzle row. Therefore, the corrective calculation is extremely simple, and since there is no change in the number of dots ejected, before and after the correction, then a merit is obtained in that the memory relating to ink ejection does not need to be expanded. However, in this case, there is a possibility that even in high-quality mode, it is only possible to increase the number of pixels per unit surface area, but it is not possible to eject small dots.

On the other hand, if the design in the latter mode (2) is adopted (in other words, a design where liquid droplets which are smaller than those from the main nozzles are ejected from the corrective nozzles), then although a superior feature is obtained in that small dots can be ejected from c3 and c4 in high-equality mode, if the dot data is simply shifted to the corrective nozzles as described above, then the amount of ink deposited onto the surface of the paper will change. As a result of this, there is a possibility that change in the optical density or change in the color (hue) may occur.

Consequently, when the design according to the mode (2) above is adopted, it is desirable to switch the corrective process as described below, in accordance with the optical density of the ink (for example, cyan) which is ejected by the nozzle group under examination, concerning the image that is being recorded.

EXAMPLE 1

Method of Dividing Whole Density Region Into Low Density, Medium Density and High Density If the whole region is divided into a low-density region, a medium-density region and a high-density region, then the approximate reference measures for these respective regions are divided as indicated below, using the droplet ejection rate as an indicator (namely, the ratio of dots actually ejected, with respect to the total region of possible droplet ejection). In other words, if the droplet ejection rate is taken to be p, then the reference measure of the low-density region is $0 \leqq p < 1/4$, the reference measure of the medium-density region is $1/4 \leqq p \leqq 2/3$, and the reference measure of the high-density region is $2/3 < p \leqq 1$.

Figure 14B:
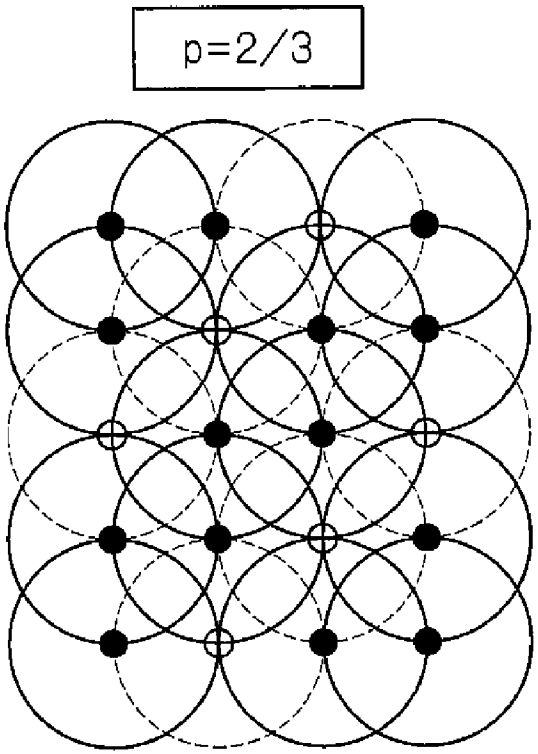
FIGS. 14A and 14B are dot arrangement diagrams showing where
Figure 14A:
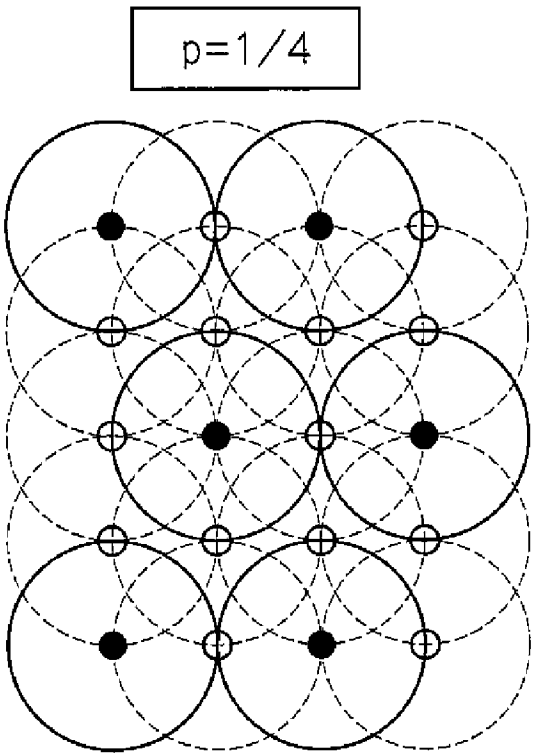

For reference purposes, FIGS. 14A and 14B shows states where p=¼ and ⅔. FIGS. 14A and 14B show states where the normal dot (main dot) diameter=42 μm, and the dot pitch=21 μm. "p=¼" can be taken to mean "a region where the dots do not overlap with each other", and "p=⅔" can be taken to mean "a region where there are no gaps between the dots". In any case, the figures given above are no more than reference measures, and desirably, those are determined appropriately on the basis of the actual dot pitch and dot diameter.

If Printing a Low-density Image:

In this case, the dots are ejected sparsely, and therefore banding, which is the issue to which the present application relates, is not particularly visible. If the correction described above is carried out in this case, then the optical density will vary due to change in the dot diameters and hence counterproductive effects might be obtained in terms of image quality. Consequently, with respect to this region, the correction is not carried out.

If Printing a Medium-density Image:

In this case, the correction is carried out. In this case, the correction is implemented in such a manner that the total number of corrective dots is greater than the total number of dots that were to have been ejected by the corrected nozzles, and in such a manner that the total volume of the liquid droplets of the corrective dots is smaller than the total volume of the liquid droplets that were to have been ejected by the corrected nozzles (in other words, the correction is implemented as described in the above "Method of ejecting droplets for corrective dots"). For example, if the volume of one droplet for a main dot is 5 pl, and the volume of one droplet for a corrective dot is 2 pl, then two corrective dots are substituted for one main dot. By implementing the correction in this fashion, it is possible to minimize any alteration in the optical density or color hue, which may be a concern as a result of the correction. In this density region, the correction is performed for all of the dots formed by the droplets from the nozzles that are being corrected.

If Printing a High-density Image:

In this case, rather than shifting all of the dots from the nozzles that are being corrected, to the corrective nozzles, only the droplet ejection from a portion thereof (for example, ⅔ of the total) are desirably, shifted to droplet ejection from the corrective nozzles (this method is similar to that adopted in cases of "if printing a medium-density image"), and the remainder (for example, ⅓ of the total) are desirably ejected from the corrected nozzles (in other words, these dots are not corrected). In so doing, the number of ejecting nozzles increases, for example, to "c1 and c2 and c4", or "c1 and c2 and c3", and therefore a larger memory is required for the nozzle data. However, by ejecting from the corrected nozzles as well, it is possible to suppress decline in the optical density. As described previously, these are determined on the basis of various parameters, such as the ratio between the ejected liquid droplet volumes of the main nozzles and the corrective nozzles, the density of the coloring material in the ink that is being ejected, and the like.

EXAMPLE 2

Method of Dividing Whole Density Region Into Low Density and High Density

If the whole density region is divided into two regions, a low-density region and a high-density region, then taking the droplet ejection rate (the ratio of the dots actually ejected, with respect to the total region of possible droplet ejection) to be p, the approximate reference measures of the respective regions are such that, for example, a range of $0 \leqq p < 1/4$ is taken as the reference measure for the low-density region and a range of $1/4 < p \leqq 1$ is taken as the reference measure for the high-density region. In any case, as stated previously, the figures given above are no more than reference measures, and desirably, those are determined appropriately on the basis of the actual dot pitch and dot diameter.

If Printing a Low-density Image:

In this case, similarly to the "Example 1" described above, the dots are ejected sparsely, and therefore banding, which is the issue to which the present application relates, is not particularly visible. If the correction described above is carried out in this case, then the optical density will vary due to change in the dot diameters and hence counterproductive effects will be obtained in terms of image quality. Consequently, concerning this region, the correction is not carried out.

If Printing a High-density Image:

In this case, the correction is carried out. In this case, the correction is implemented in such a manner that the total number of corrective dots is greater than the total number of dots that were to have been ejected by the corrected nozzles, and in such a manner that the total volume of the liquid droplets of the corrective dots is smaller than the total volume of the liquid droplets that were to have been ejected by the corrected nozzles (in other words, the correction is implemented as described in the above "Method of ejecting droplets for corrective dots"). For example, if the volume of one droplet for a main dot is 5 pl, and the volume of one droplet for a corrective dot is 2 pl, then two corrective dots are substituted for one main dot. By implementing the correction in this fashion, it is possible to minimize any alteration in the optical density or color hue, which may be a concern as a result of the correction.

Second Embodiment

Next, a further embodiment of the present invention will be described.

Figure 15:
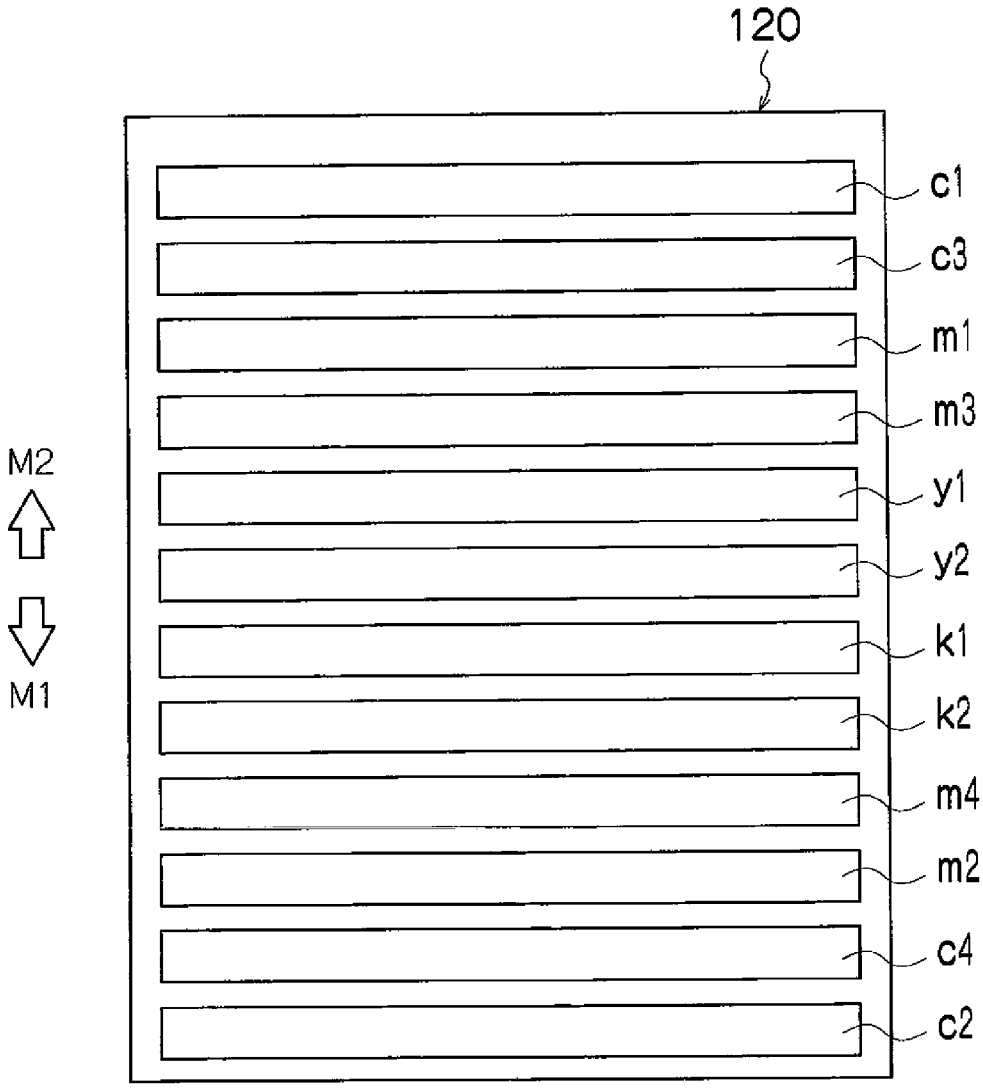
FIG. 15 is a schematic drawing showing an example of the arrangement of nozzle rows in a recording head according to a second embodiment of the present invention.
Figure 16:
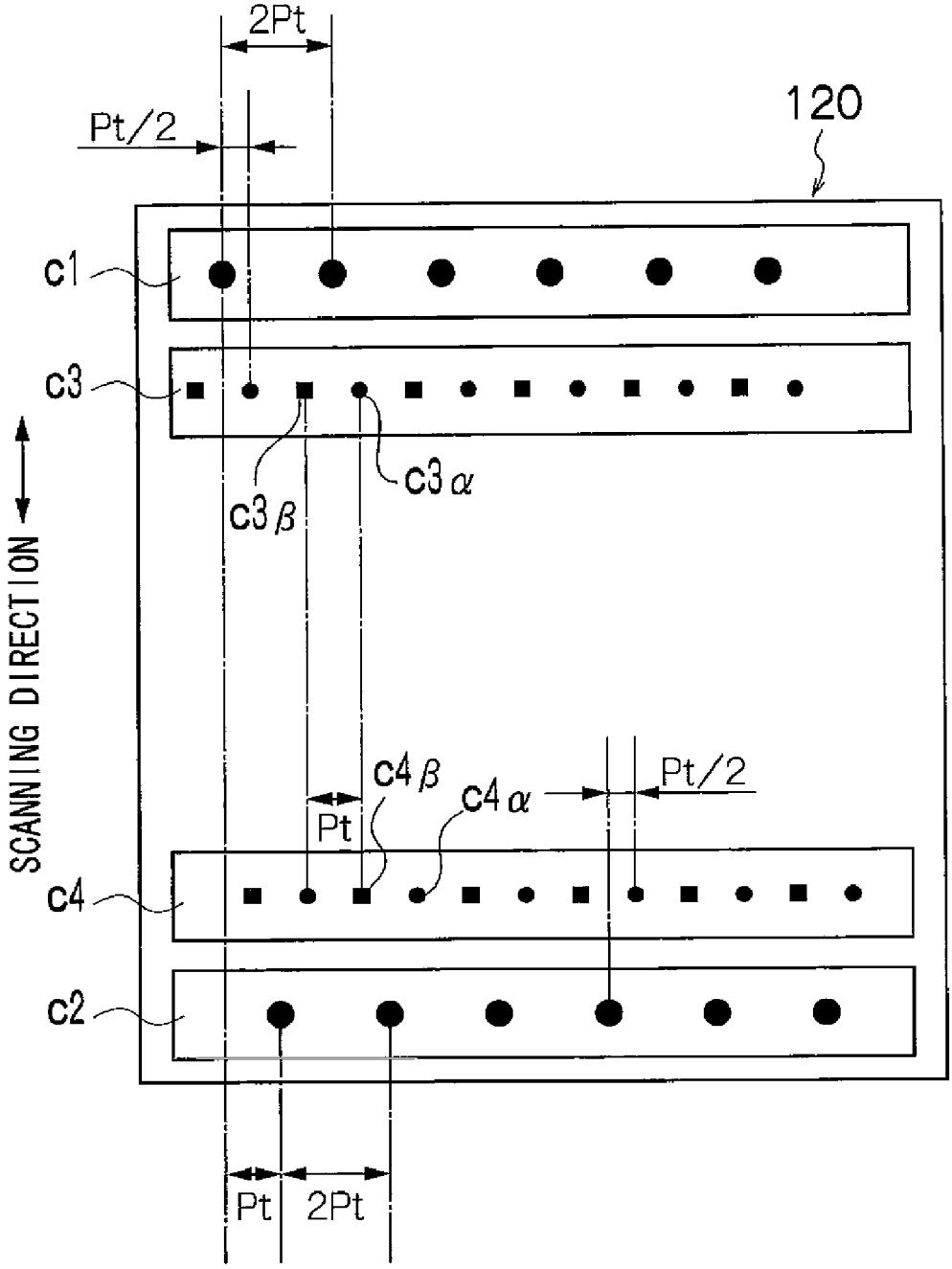
FIG. 16 is a drawing showing the arrangement of cyan nozzles in the recording head according to the second embodiment.

FIG. 15 is a schematic drawing showing the nozzle row arrangement for all colors in the recording head used in the second embodiment. FIG. 16 shows the arrangement of nozzles relating to the cyan nozzle rows c1 to c4, which are arranged in the outermost portions of the depicted recording head 120. The nozzle rows c3 and c4 shown in FIG. 16 have nozzles twice as many as the number of nozzles of the main nozzle rows c1 and c2, and the nozzles of the nozzle row c3 (c3α and c3β) are arranged at positions Pt/2 to the left-hand and right-hand side of each main nozzle belonging to the nozzle row c1.

Similarly, the nozzles of the nozzle row c4 (c4α and c4β) are arranged at positions Pt/2 to the left-hand and right-hand side of each main nozzle belonging to the nozzle row c2. The nozzles c3α of the nozzle row c3 and the nozzles c4β of the nozzle row c4 are arranged at the same positions in terms of the main scanning direction as shown in FIG. 16.

Looking in particular at the main nozzle rows c1 and c2, the main nozzles are arranged in a staggered fashion by means of these two rows, and the effective nozzle pitch between the main nozzles (the pitch in the sub-scanning direction) is Pt. The nozzles of nozzle rows c3 and c4 are arranged at positions Pt/2 to either side of each main nozzle, and therefore the effective nozzle pitch in the staggered arrangement formed by the four rows c1 to c4 is Pt/2.

In FIG. 16, the nozzles belonging to c3 and c4 are represented by the symbols "●" and "■", and are respectively called c3α, c3β, and so on, but these are for the purpose of the description given below, and the actual nozzle shapes, and the like, are the same (for example, a round shape). Furthermore, the dots ejected from c3, c4, m3 and m4 are smaller than the dots ejected respectively from c1, c2, m1 and m2.

The following description relates to correction for cyan, but in the same way as the first embodiment, it is possible to carry out similar correction in respect of magenta also.

Calculation of Amount of Inclination of the Head

The amount of inclination of the head is calculated by means of the same method as that used in the first embodiment described above. More specifically, liquid droplets are ejected from a particular group of nozzles, of the main nozzles, thereby forming lines of dots, and the interval L between these lines is read out and the differential ΔL with respect to the reference value L0 (L−L0=ΔL) is determined. If this differential L0 exceeds a reference value, then correction (changing of the ejection nozzles) such as that described in the section below is carried out.

Premise of Sequence for Judging Whether or Not to Carry Out Correction

"The prescribed judgment reference value" which forms a reference for judging whether or not to carry out the correction (by changing the ejection nozzles) is determined in the following manner.

Figure 17:
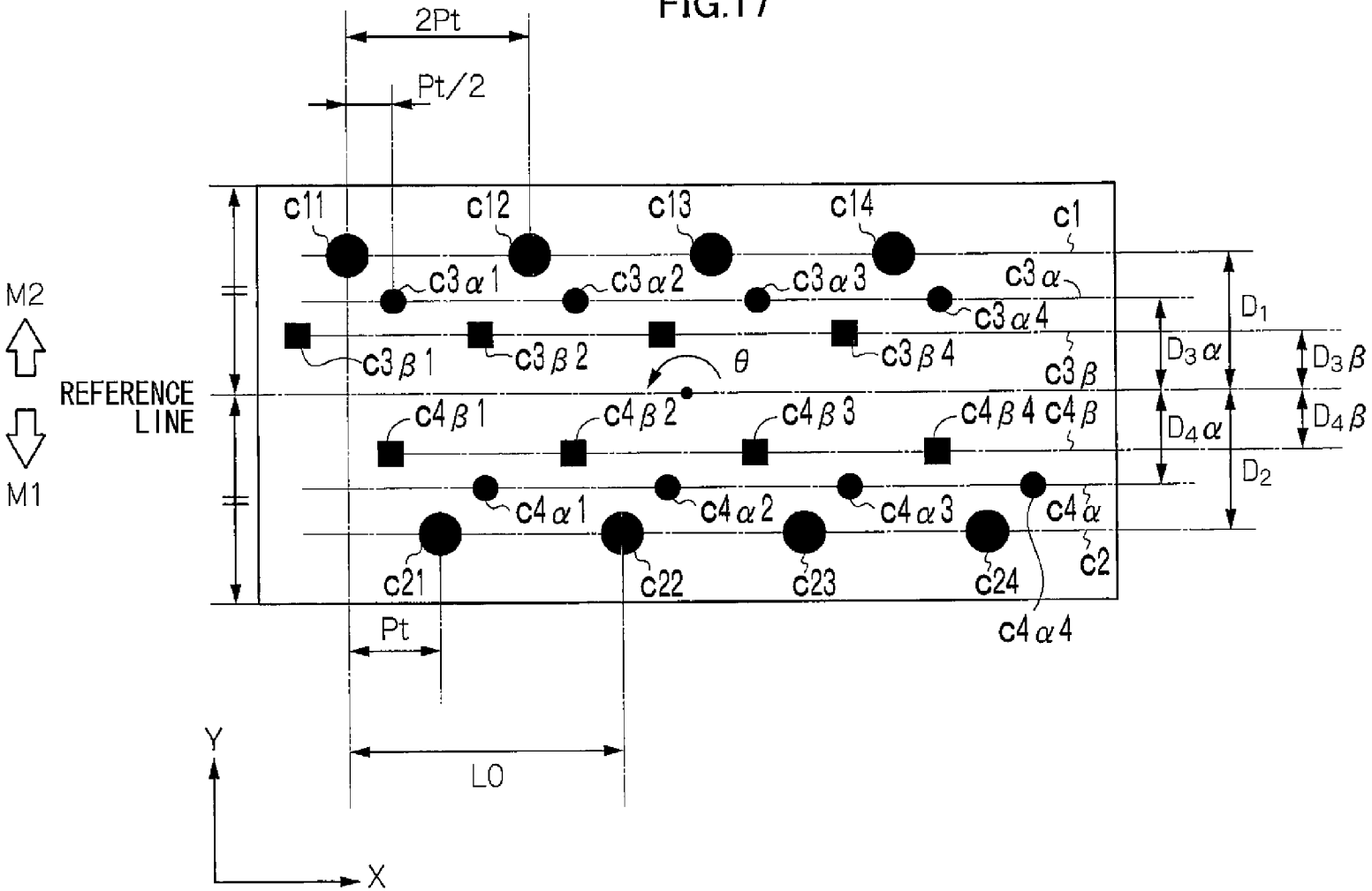
FIG. 17 is a general schematic drawing showing the arrangement of cyan nozzles in the recording head according to the second embodiment.

Firstly, as shown in FIG. 17, the lengths of the respective parts are defined. The reference line is the center line in terms of the Y direction of the head (the main scanning direction in the case of a serial type head). It is possible that "$D_3\alpha=D_3\beta$" and "$D_4\alpha=D_4\beta$" are satisfied. The nozzle rows c3 and c4 shown in FIG. 16 are in a mode where $D_3\alpha=D_3\beta$ and $D_4\alpha=D_4\beta$ in FIG. 17.

The respective calculations are the same as those of the example described in FIG. 8, and therefore description of the calculation sequence is omitted here and only the results are described below.

(1) If the Amount of Rotation of the Head θ>0, (ΔL>0):

If the scanning direction is M1 (see FIG. 15 and FIG. 17):

(1a) if ΔL≦ΔLb3α, then no correction is performed; and (1b) if ΔL>ΔLb3α, then (a portion of) the dots created by c1 are replaced with dots created by c3α.

If the scanning direction is M2 (see FIG. 15 and FIG. 17):

(1c) if ΔL≦ΔLb4β, then no correction is performed; and (1d) if ΔL>ΔLb4β, then (a portion of) the dots created by c2 are replaced with dots created by c4β.

In other words, when the head scanning direction is M1, then if the amount of inclination has exceeded the threshold value, (a portion of) the dots created by c1 are replaced with dots created by c3α (in other words, droplets are ejected by c2 and c3α). On the other hand, when the scanning direction is M2, then if the amount of inclination has exceeded the threshold value, (a portion of) the dots created by c2 are replaced with dots created by c4β (in other words, droplets are ejected by c1 and c4β). By this means, when the correction has been implemented, the droplets always land on the recording medium in the sequence of main dot (large dot) first and then a corrective dot (small dot) (i.e. a main dot (large dot)→a corrective dot (small dot)).

(2) If the Amount of Rotation of the Head θ<0, (ΔL<0):

If the scanning direction is M1:

(2a) if ΔL≧ΔLb3β, then no correction is performed; and (2b) if ΔL<ΔLb3β, then (a portion of) the dots created by c1 are replaced with dots created by c3β.

If the scanning direction is M2:

(2c) if ΔL≧ΔLb4α, then no correction is performed; and (2d) if ΔL<ΔLb4α, then (a portion on the dots created by c2 are replaced with dots created by c4α.

In other words, when the head scanning direction is M1, then if the amount of inclination has exceeded the threshold value, (a portion of) the dots created by c1 are replaced with dots created by c3β (in other words, droplets are ejected by c2 and c3β). On the other hand, when the scanning direction is M2, then if the amount of inclination has exceeded the threshold value, (a portion of) the dots created by c2 are replaced with dots created by c4α (in other words, droplets are ejected by c1 and c4α). By this means, when the correction has been implemented, the droplets always land on the recording medium in the sequence of a main dot (large dot) first and then a corrective dot (small dot) (i.e., a main dot (large dot)→a corrective dot (small dot)).

Under the conditions (1a) to (1d) and (2a) to (2d) described above, the following formulas are satisfied.

$$\Delta Lb3\alpha = \frac{1}{2} \times \frac{D_1 + D_2}{D_1 + D_3\alpha + 2D_2} Pt \qquad \text{Formula 11}$$

$$\Delta Lb4\beta = \frac{1}{2} \times \frac{D_1 + D_2}{D_2 + D_4\beta + 2D_1} Pt \qquad \text{Formula 12}$$

$$\Delta Lb3\beta = -\frac{1}{2} \times \frac{D_1 + D_2}{D_1 + D_3\beta + 2D_2} Pt \qquad \text{Formula 13}$$

-continued $$\Delta Lb4\alpha = -\frac{1}{2} \times \frac{D_1 + D_2}{D_2 + D_4\alpha + 2D_1} Pt \quad \text{Formula 14}$$

Now, if (0<) ΔLb3α≦ΔLb4β and ΔLb3β≦ΔLb4α (<0), then the conditions (1a) to (1d) and (2a) to (2d) stated above can be summarized as the following items <1> to <5>.

<1>: If ΔL<ΔLb3β, then in the scanning direction M1, (a portion of) the dots created by c1 are replaced with dots created by c3β, and in the scanning direction M2, (a portion of) the dots created by c2 are replaced with dots created by c4α.

<2>: If ΔLb3β≦ΔL<ΔLb4α, then in the scanning direction M1, no correction is performed, and in the scanning direction M2, (a portion of) the dots created by c2 are replaced with dots created by c4α.

<3>: If ΔLb4α≦ΔL≦ΔLb3β, then no correction is performed in either scanning direction M1 or M2.

<4>: If ΔLb3α<ΔL≦ΔLb4β, then in the scanning direction M1, (a portion of) the dots created by c1 are replaced with dots created by c3α, and in the scanning direction M2, no correction is performed.

<5>: If ΔLb4β<ΔL, then in the scanning direction M1, (a portion of) the dots created by c1 are replaced with dots created by c3α, and in the scanning direction M2, (a portion of) the dots created by c2 are replaced with dots created by c4β.

By determining the ejection nozzles in this way, it is possible to form an image in which banding is not readily visible.

In FIG. 17, the distance in the X direction between the main nozzles and the corrective nozzles is Pt/2 in all cases, but it does not always have to be this value.

If the distance in the X direction between the nozzles in c1 and the nozzles in c3α is taken to be k3α×Pt;

the distance in the X direction between the nozzles in c1 and the nozzles in c3β is taken to be k3β×Pt;

the distance in the X direction between the nozzles in c2 and the nozzles in c4α is taken to be k4α×Pt; and the distance in the X direction between the nozzles in c2 and the nozzles in c4β is taken to be k4β×Pt;

then ΔLb3α, ΔLb4β, ΔLb3β and ΔLb4α are respectively expressed by the following.

$$\Delta Lb3\alpha = k3\alpha \times \frac{D_1 + D_2}{D_1 + D_3\alpha + 2D_2} Pt \quad \text{Formula 15}$$

$$\Delta Lb4 = k4\beta \times \frac{D_1 + D_2}{D_2 + D_4\beta + 2D_1} Pt \quad \text{Formula 16}$$

$$\Delta Lb3\beta = -k3\beta \times \frac{D_1 + D_2}{D_1 + D_3\beta + 2D_2} Pt \quad \text{Formula 17}$$

$$\Delta Lb4\alpha = -k4\alpha \times \frac{D_1 + D_2}{D_2 + D_4\alpha + 2D_1} Pt \quad \text{Formula 18}$$

Based upon these Formulas, it is possible to employ the conditions stated in <1> to <5> above.

Droplet Ejection Sequence for Dots in the Case of Bidirectional Printing

The printing example according to the second embodiment described above is described here with reference to the condition <5> above. The same approach can be adopted in the case of condition <1> also. In the second embodiment, the recording head is moved in two directions, M1 and M2 in FIG. 15. Therefore, all of the recording nozzles are divided into those which eject droplets to form dots when scanning in the direction M1 and those which eject droplets to form dots when scanning in the direction M2. This can be achieved by dividing up the dot data by means of two mutually complementary masks (masks which divide the data into data of pixel positions where droplets are to be ejected during scanning in direction M1 and data of pixel positions where droplets are to be ejected during scanning in direction M2).

Figure 18:
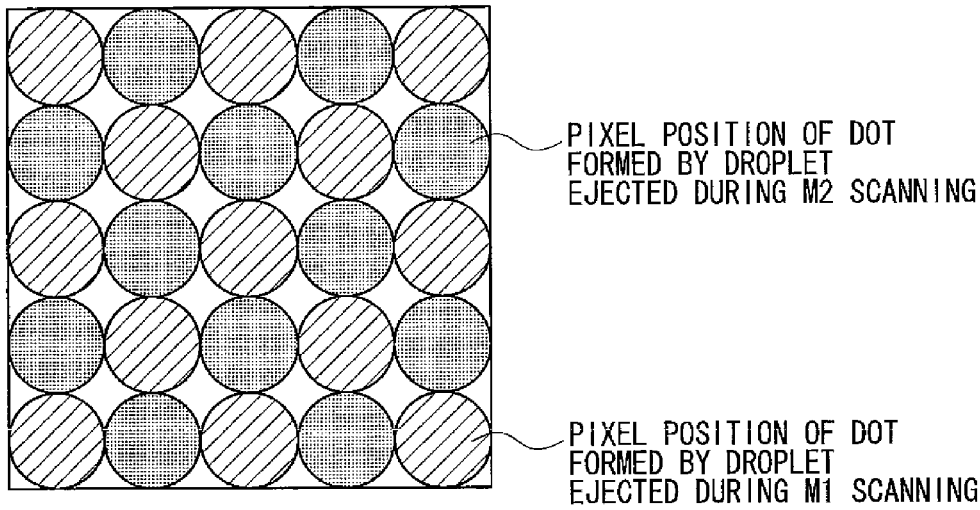
FIG. 18 is a diagram showing the arrangement of the pixel positions of dots formed by droplets ejected in respective directions, in the case of bidirectional printing.

More specifically, as shown in FIG. 18, it is possible to adopt staggered masks in which the pixel positions of the dots formed by droplets ejected when scanning in the direction M1 (the positions filled in with diagonal hatching in FIG. 18) and the pixel positions of the dots formed by droplets ejected when scanning in the direction M2, are arranged in an alternating fashion.

As FIG. 16 and FIG. 17 reveal, when the recording head 120 according to the present embodiment moves in the direction M1, the nozzle rows pass over the same position on the recording medium in the sequence c2→c4→c3→c1. In this case, the dots created by c1 are replaced with dots created by c3α, and hence droplets are ejected from the nozzles of c2 and c3α.

On the other hand, if the recording head 120 moves in the direction M2, then the nozzle rows pass over the same position on the recording medium in the sequence c1→c3→c4→c2. In this case, the dots created by c2 are replaced with dots created by c4β, and hence droplets are ejected from the nozzles of c1 and c4β.

By adopting this approach, the sequence in which the dots land on the recording medium is always the same (in this case, a sequence of large dot followed by small dot (large dot→small dot)), regardless of the scanning direction of the recording head 120, and therefore it is possible to form an image having excellent color stability.

A method similar to that of the first embodiment is used to carry out the correction in accordance with the density.

Third Embodiment

Next, yet a further embodiment of the present invention will be described.

Figure 19:
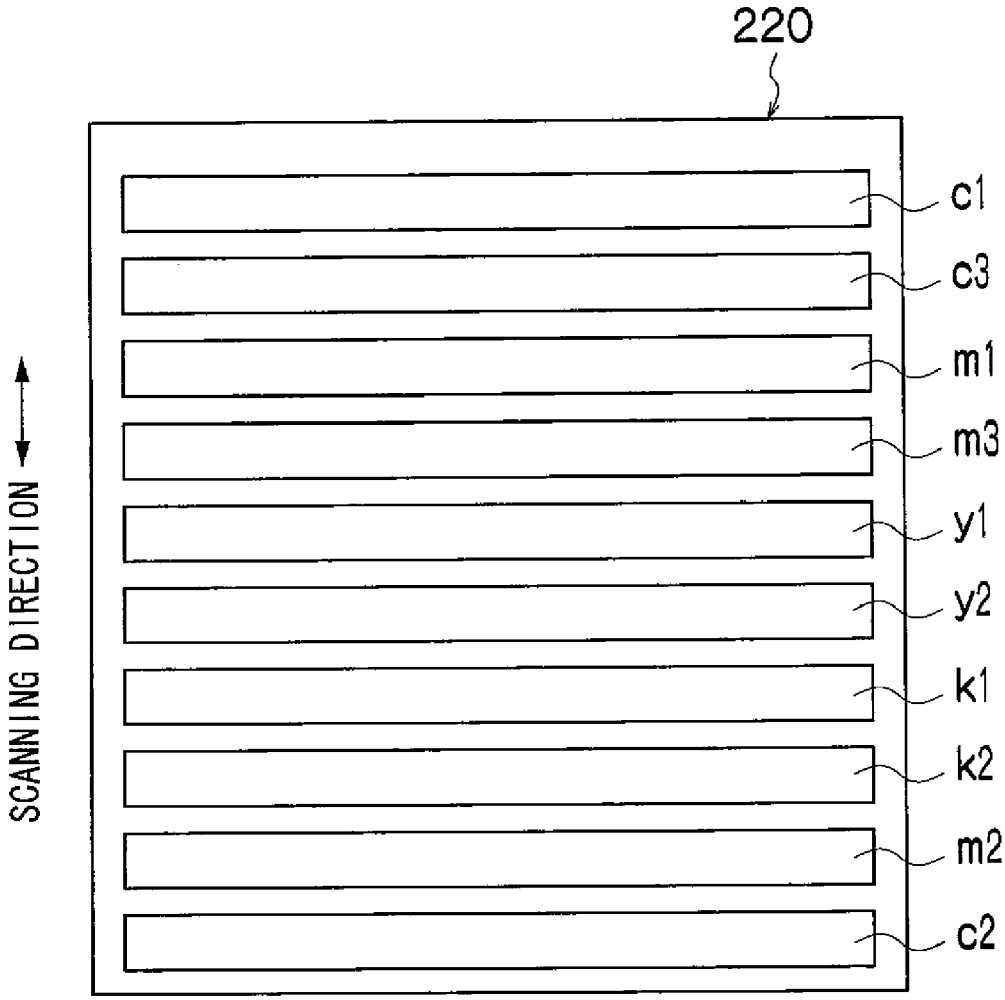
FIG. 19 is a schematic drawing showing an example of the arrangement of nozzle rows in the recording head according to a third embodiment of the present invention.

FIG. 19 is a schematic drawing showing the nozzle row arrangement for all colors in the recording head used in a third embodiment of the invention. The recording head 220 shown in FIG. 19 differs from the recording head 120 shown in FIG. 15 and FIG. 16 in that it does not comprise the nozzle rows c4 and m4.

Figure 20:
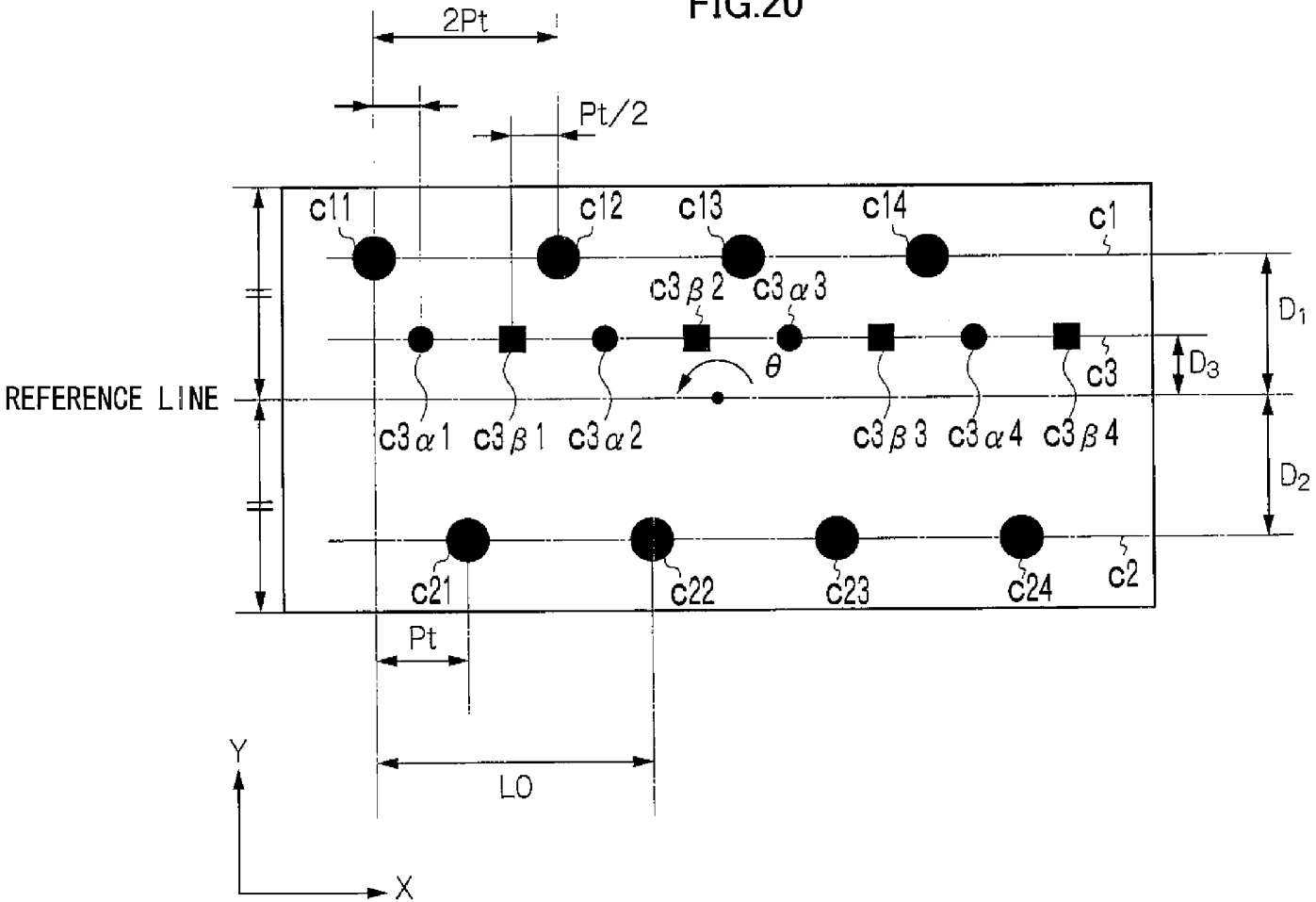
FIG. 20 is a general schematic drawing showing the arrangement of cyan nozzles in the recording head according to the third embodiment.
Figure 21:
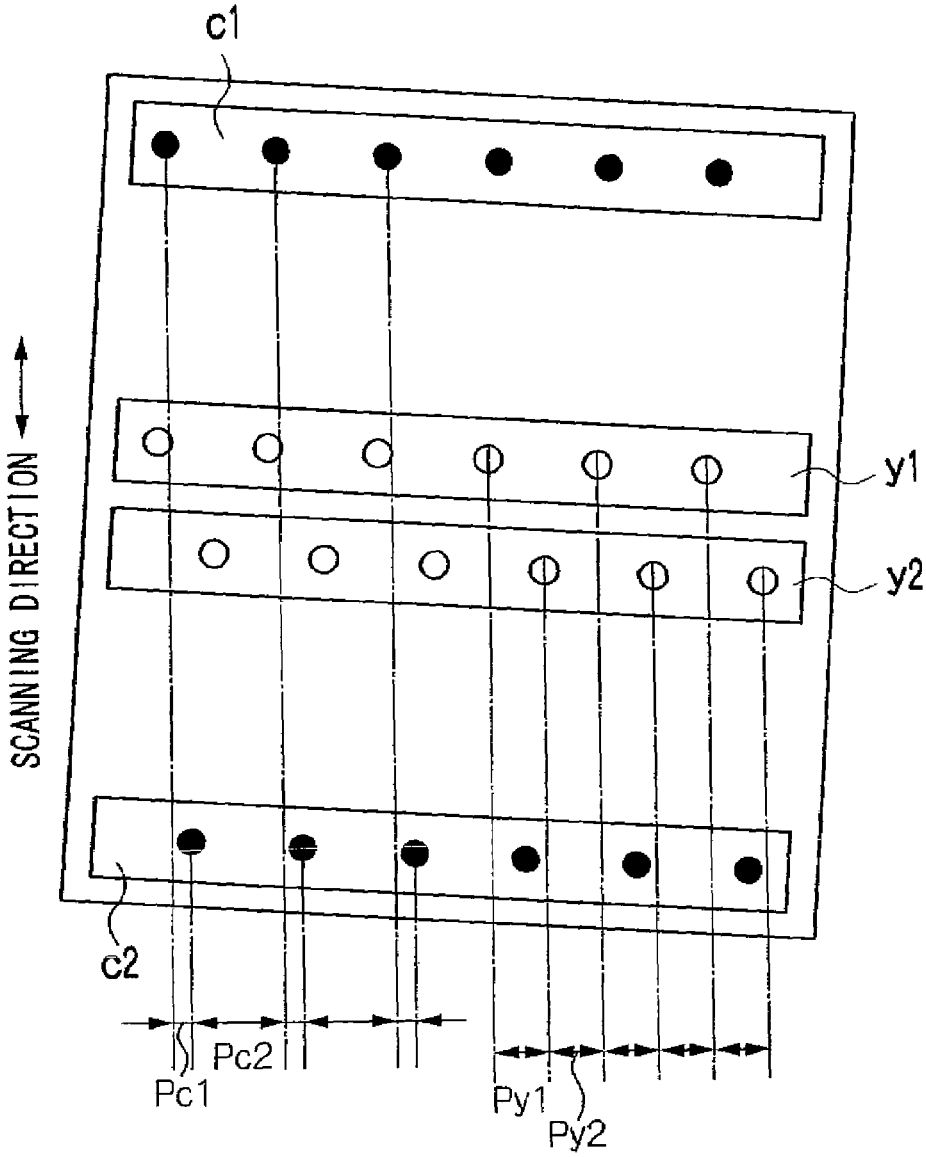
FIG.21 RELATED ART
FIG. 21 is an illustrative diagram for describing problems of the related art.

FIG. 20 shows the arrangement of nozzles relating to the cyan nozzle rows c1 to c3, which are arranged in the outermost portions of the recording head 220 shown in FIG. 19. The nozzle row c3 shown in FIG. 20 has twice the number of nozzles as each of the main nozzle rows c1 and c2, and nozzles of the nozzle row c3 (c3α and c3β) are arranged, respectively, at positions Pt/2 to the left-hand and right-hand side of each single main nozzle belonging to the nozzle row c1.

Looking in particular at the main nozzle rows c1 and c2, the main nozzles are arranged in a staggered fashion by means of these two rows, and the effective nozzle pitch between the main nozzles (the pitch in the sub-scanning direction) is Pt. The nozzles of nozzle row c3 are arranged at positions Pt/2 to either side of each main nozzle, and therefore the effective nozzle pitch in the staggered arrangement formed by the three rows c1 to c3 is Pt/2.

In FIG. 20, the nozzles belonging to c3 are represented by the symbols "●" and "■", and are respectively called c3α1, c3β1, and so on, but these symbols are for the purpose of the description given below, and the actual nozzle shapes, and the like, are the same (for example, a round shape). Furthermore, the dots ejected from c3 and m3 are smaller than the dots ejected respectively from c1, c2, m1 and m2.

The following description relates to the correction for cyan, but in the same way as the first embodiment, it is possible to carry out similar correction in respect of magenta also.

Calculation of Amount of Inclination of the Head

The amount of inclination of the head is calculated by means of the same method as that used in the first embodiment described above. More specifically, liquid droplets are ejected from a particular group of nozzles, of the main nozzles, thereby forming lines of dots, and the interval L between these lines is read out and the differential ΔL with respect to the reference value L0 (L−L0=ΔL) is determined. If this differential ΔL exceeds a reference value, then correction (changing of the ejection nozzles) such as that described in the section below is carried out.

Premise of Sequence for Judging Whether or Not to Carry Out Correction

"The prescribed judgment reference value" which forms a reference for judging whether or not to carry out correction (by changing the ejection nozzles) is determined in the following manner.

Firstly, as shown in FIG. 20, the lengths of the respective parts are defined. The reference line is the center line in terms of the Y direction of the head (the main scanning direction in the case of a serial type head). The respective calculations are the same as those of the example described in FIG. 8, and therefore description of the calculation sequence is omitted here and only the results are described below.

(1) If the Amount of Rotation of the Head θ>0, (ΔL>0):
  (a) If ΔL≦ΔLb3α, then no correction is performed; and
  (b) if ΔL>ΔLb3α, then (a portion of) the dots created by c1 are replaced with dots created by c3α.

(2) If the Amount of Rotation of the Head θ<0, (ΔL<0):
  (c) If ΔL≦ΔLb3β, then no correction is performed; and
  (d) if ΔL>ΔLb3β, then (a portion of) the dots created by c1 are replaced with dots created by c3β.

Here, the following equations are satisfied.

$$\Delta Lb3\alpha = \frac{1}{2} \times \frac{D_1 + D_2}{D_1 + D_3 + 2D_2} Pt \quad \text{Formula 19}$$

$$\Delta Lb3\beta = -\frac{1}{2} \times \frac{D_1 + D_2}{D_2 + D_4 + 2D_1} Pt \quad \text{Formula 20}$$

The above conditions (a) to (d) can be summarized into items <1> to <3> below.

<1>: If ΔL<ΔLb3β, then (a portion of) the dots created by c1 are replaced with dots created by c3β.

<2>: If ΔLb3β≦ΔL<ΔLb3α, then no correction is performed.

<3>: If ΔLb3α<ΔL, then (a portion of) the dots created by c1 are replaced with dots created by c3α.

In FIG. 20, the distance in the X direction between c1 and c3α and the distance in the X direction between c1 and c3β are Pt/2 in all cases, but it does not necessarily have to be this value.

If the distance in the X direction between the nozzles in c1 and the nozzles in c3α is taken to be k3α×Pt; and the distance in the X direction between the nozzles in c1 and the nozzles in c3β is taken to be k3β×Pt, then ΔLb3α and ΔLb3β are respectively expressed as the following.

$$\Delta Lb3\alpha = k3\alpha \times \frac{D_1 + D_2}{D_1 + D_3 + 2D_2} Pt \quad \text{Formula 21}$$

$$\Delta Lb3\beta = -k3\beta \times \frac{D_1 + D_2}{D_1 + D_3 + 2D_2} Pt \quad \text{Formula 22}$$

Based upon the above Formulas, it is possible to employ the conditions stated in the items <1> to <3> above.

Method of Ejecting Droplets for Corrective Dots

The method of ejecting the corrective dots is similar to that of the first embodiment, and therefore further description thereof is omitted here.

Switching Correction in Accordance with Density

The method of switching the correction in accordance with the density is similar to that of the first embodiment, and therefore further description thereof is omitted here.

In the description given above, the correction is described principally with respect to a case where a serial head (shuttle head) is installed in an inclined fashion, but the present invention may also be applied to a line head. In a line head, by disposing particular nozzle rows on the upstream side and the downstream side in terms of the paper conveyance direction, it is possible to increase the dot overlap pattern and to improve the range of color reproduction. For example, in the case of cyan and yellow, the color hue changes subtly depending on whether droplet ejection is carried out more frequently in the sequence cyan→yellow or more frequently in the sequence yellow→cyan, and therefore different colors can be reproduced depending on the droplet ejection sequence. In this case also, it is possible to apply the present invention in respect of banding caused by oblique inclination of the head upon installation, or skewed travel of the paper, or the like.

Annex

As ascertained from the description of embodiments of the present invention detailed above, the present specification includes the disclosure of technical ideas comprising various aspects of the invention described below.

Aspect (1):

One aspect of the invention is as follows: an image forming method of ejecting liquid droplets containing coloring material toward a recording medium from nozzles including main nozzles and subsidiary nozzles of nozzle rows of a recording head while causing relative movement between the recording medium and the recording head in a relative movement direction that is substantially perpendicular to a direction of alignment of the nozzles of each of the nozzle rows in such a manner that an image is formed by the coloring material on the recording medium, wherein the nozzle rows include first and second nozzle rows which have the main nozzles corresponding to a same coloring material of a particular color and at least one subsidiary nozzle row which includes the subsidiary nozzles corresponding to the same coloring material of the particular color; the first and second nozzle rows and the at least one subsidiary nozzle row are respectively arranged at different positions in terms of the relative movement direction; the at least one subsidiary nozzle row is disposed between the first and second nozzle rows; and the subsidiary nozzles are arranged in such a manner that positions of the subsidiary nozzles projected on a straight line in the direction of alignment of the nozzles of each of the nozzle rows are different from positions of the main nozzles projected on the straight line, and wherein the image forming method includes: a measurement step of measuring an amount of inclination of the recording head with respect to the relative movement direction; a correction judgment step of judging whether or not correction is necessary according to the amount of inclination measured in the measurement step; and a correction step of carrying out droplet ejection from at least a portion of the subsidiary nozzles, in place of droplet ejection from at least a portion of the main nozzles when judgment is made, in the correction judgment step, that the correction is necessary, so that the correction is performed.

According to this aspect, it is possible to reduce banding caused by inclination of the head.

In the case of a serial head, "the relative movement direction" is the main scanning direction in which the head moves reciprocally, and the "nozzle alignment direction" in this case is the sub-scanning direction. Furthermore, in the case of a full line head having a page-wide recording breadth, the "relative movement direction" is the direction of conveyance of the recording medium (sub-scanning direction), and in this case, the "nozzle alignment direction" corresponds to the main scanning direction.

A full line head is not limited to one composed by means of a single long head which extends through a length corresponding to the full width of the recording medium, and it is also possible to adopt a mode in which a plurality of relatively short recording head modules, each having nozzle rows of a length shorter than the full width, are assembled and joined together in such a manner that a page-wide recording width is achieved overall.

A full line type (page-wide) head is usually disposed in a direction that is perpendicular to the relative feed direction (relative conveyance direction) of the recording medium, but a mode may also be adopted in which the recording head is disposed following an oblique direction that forms a prescribed angle with respect to the direction perpendicular to the conveyance direction.

"Recording medium" indicates a medium on which an image is recorded by means of the action of the recording head (this medium may also be called an image forming medium, image receiving medium, ejection medium, or the like). This term includes various types of media, irrespective of material and size, such as continuous paper, cut paper, scaled paper, resin sheets such as OHP sheets, film, cloth, an intermediate transfer body, a printed circuit board on which a wiring pattern, or the like, is formed by means of an inkjet recording apparatus, and the like.

The device for causing the recording head and the recording medium to move relatively with respect to each other may have a mode where the recording medium is conveyed with respect to a stationary (fixed) recording head, or a mode where a recording head is moved with respect to a stationary recording medium, or a mode where both the recording head and the recording medium are moved.

When forming color images by means of an inkjet head, it is possible to provide recording heads for respective colors of a plurality of colored inks (recording liquids) (namely, color-specific head modules), or it is possible to eject inks of a plurality of colors, from one recording head.

Aspect (2):

Another aspect of the invention is as follows: the image forming method as defined in Aspect (1), wherein the at least one subsidiary nozzle row includes a third nozzle row and a fourth nozzle row; and in the correction step, the droplet ejection from the subsidiary nozzles of one nozzle row of the third and the fourth nozzle rows is carried out, in place of the droplet ejection from the main nozzles of one nozzle row of the first and second nozzle rows.

According to this aspect, it is possible to carry out the correction described above more effectively.

Aspect (3):

Another aspect of the invention is as follows: the image forming method as defined in Aspect (2), further including a nozzle row determination step of determining the one nozzle row of the third and the fourth nozzle rows, including the subsidiary nozzles from which the droplet ejection is carried out in place of the droplet ejection from the main nozzles of one nozzle row of the first and second nozzle rows in the correction step, according to a direction of the inclination measured in the measurement step.

According to this aspect, due to the characteristics of the mode of arrangement of the nozzle rows, it is possible to select the row of subsidiary nozzles which is effective for correction.

Aspect (4):

Another aspect of the invention is as follows: the image forming method as defined in any one of Aspects (1) to (3), wherein volumes of the liquid droplets ejected from the subsidiary nozzles and the main nozzles are substantially same.

According to this aspect, it is possible to make the main nozzles and the subsidiary nozzles have the same nozzle shape (nozzle diameter), and therefore it is possible to simplify the manufacturing process for the nozzle section.

Aspect (5):

Another aspect of the invention is as follows: the image forming method as defined in Aspect (4), wherein, in the correction step, the droplet ejection from the at least a portion of the subsidiary nozzles is carried out in place of all of the droplet ejection from the main nozzles of one nozzle row of the first and second nozzle rows.

According to this aspect, it is possible to use the dot data of the main nozzles directly as data for the subsidiary nozzles, and therefore the calculation involved in the correction can be simplified. Furthermore, since the number of nozzles used remains unchanged, whether or not the correction is carried out, then it is not necessary to increase the memory used to store the data (ejection information) relating to ink ejection.

Aspect (6):

Another aspect of the invention is as follows: the image forming method as defined in any one of Aspects (1) to (3), wherein volume of the liquid droplets ejected from the subsidiary nozzles is smaller than volume of the liquid droplets ejected from the main nozzles.

By means of the subsidiary nozzles, it is possible to form smaller dots than the main nozzles, and therefore, by using these subsidiary nozzles, it is possible to create images of even higher quality.

Aspect (7):

Another aspect of the invention is as follows: the image forming method as defined in Aspect (6), further comprising a mode switching step of switching a recording operation between a first recording mode and a second recording mode in which recording is performed at a higher resolution than in the first recording mode, wherein when the recording operation is switched to the first recording mode in the mode switching step, the correction step is carried out.

According to his aspect, if the second recording mode has been selected, then it is possible to use the subsidiary nozzles for forming image highlights, and hence an image of even higher quality can be formed, whereas if the first recording mode has been selected, and if it is judged that the correction is necessary, then the occurrence of banding can be suppressed by using these subsidiary nozzles.

Aspect (8):

Another aspect of the invention is as follows: the image forming method as defined in Aspect (6) or Aspect (7), wherein in the correction step, total number of the liquid droplets ejected from the at least a portion of the subsidiary nozzles in place of the droplet ejection from the at least a portion of the main nozzles is greater than total number of the liquid droplets scheduled to be ejected from the at least a portion of the main nozzles subject to the correction in a hypothetical case that no correction is carried out; and in the correction step, total volume of the liquid droplets ejected from the at least a portion of the subsidiary nozzles per unit surface area of the recording medium is less than total volume of the liquid droplets scheduled to be ejected from the at least a portion of the main nozzles subject to the correction in the hypothetical case that no correction is carried out.

By means of the correction processing according to the this aspect, if droplet ejection is carried out by means of the subsidiary nozzles instead of droplet ejection from the main nozzles, then by making the total number of droplets ejected from the subsidiary nozzles (corrective nozzles) greater than the total number of the droplets that were scheduled to be ejected from the main nozzles which are being corrected, and by making the total volume of the droplets ejected from the subsidiary nozzles per unit surface area smaller than the total volume of the droplets that were scheduled to be ejected from the main nozzles which are being corrected, then it is possible to make the optical density and color hue of the correction result approximate the ideal reproduction target more closely.

Aspect (9):

Another aspect of the invention is as follows: the image forming method as defined in any one of Aspects (6) to (8), wherein in the correction step, total number of the liquid droplets ejected from the at least a portion of the subsidiary nozzles in place of the droplet ejection from the at least a portion of the main nozzles is greater than total number of the liquid droplets scheduled to be ejected from the at least a portion of the main nozzles subject to the correction in a hypothetical case that no correction is carried out; and in the correction step, total surface area of dots on the recording medium created by the liquid droplets ejected from the at least a portion of the subsidiary nozzles per unit surface area of the recording medium is greater than total surface area of dots on the recording medium created by the liquid droplets scheduled to be ejected from the at least a portion of the main nozzles subject to the correction in the hypothetical case that no correction is carried out.

By means of the correction processing according to this aspect, it is possible to make the optical density and the color hue of the correction result approximate the ideal reproduction target more closely.

Aspect (10):

Another aspect of the invention is as follows: the image forming method as defined in any one of Aspects (6) to (9), wherein, in the correction step, a replacement ratio of the at least a portion of the main nozzles from which the droplet ejection is replaced with the droplet ejection from the at least a portion of the subsidiary nozzles is varied in accordance with density of the image formed on the recording medium.

By changing the ratio of main nozzles which are to be corrected (including a case where no correction is implemented at all), in accordance with the optical density of the image to be printed, it is possible to minimize any excessive correction or decline in color reproduction, and therefore correction can be performed more effectively.

Aspect (11):

Another aspect of the invention is as follows: the image forming method as defined in claim 1, wherein, in the correction judgment step, the judgment of whether or not the correction is necessary is made according to variation in a distance in a direction perpendicular to the relative movement direction, between the main nozzles belonging to the first nozzle row and the main nozzles belonging to the second nozzle row, and a distance in the relative movement direction between the first and second nozzle rows.

The judgment of whether or not to carry out the correction is made by comparing a reference value with the distance between the main nozzles belonging to the first nozzle row and the main nozzles belonging to the second nozzle row (the distance in the direction perpendicular to the direction of relative movement), while taking account of the mode of arrangement of the nozzle rows and the amount of inclination of the head. Desirably, the reference value used in this comparison is one which reflects the mode of arrangement of the nozzle rows (distance between rows, and the like).

Aspect (12):

Another aspect of the invention is as follows: the image forming method as defined in any one of Aspects (1) to (11), wherein the nozzle rows include nozzle rows which correspond respectively to cyan, magenta, yellow and black coloring materials, at least; and the particular color is at least one of cyan and magenta.

Aspect (13):

Another aspect of the invention is as follows: an image forming apparatus comprising: a recording head which has nozzle rows having nozzles including main nozzles and subsidiary nozzles, the nozzle rows including first and second nozzle rows which include the main nozzles corresponding to a same coloring material of a particular color and at least one subsidiary nozzle row which includes the subsidiary nozzles corresponding to the same coloring material of the particular color, the first and second nozzle rows and the at least one subsidiary nozzle row being respectively arranged at different positions in terms of a relative movement direction that is substantially perpendicular to a direction of alignment of the nozzles of each of the nozzle rows, the at least one subsidiary nozzle row being disposed between the first and second nozzle rows, the subsidiary nozzles being arranged in such a manner that positions of the subsidiary nozzles projected on a straight line in the direction of alignment of the nozzles of each of the nozzle rows being different from positions of the main nozzles projected on the straight line; a measurement device which measures an amount of inclination of the recording head with respect to the relative movement direction; a correction judgment device which judges whether or not correction is necessary according to the amount of inclination measured by the measurement device; and a correction device which carries out droplet ejection from at least a portion of the subsidiary nozzles, in place of droplet ejection from at least a portion of the main nozzles when judgment is made, by the correction judgment device, that the correction is necessary, in such a manner that the correction is carried out, wherein the recording head ejects liquid droplets containing coloring material toward a recording medium while relative movement is caused between the recording medium and the recording head in the relative movement direction in such a manner that an image is formed by the coloring material on a recording medium.

This Aspect (13) provides an apparatus which realizes the method of Aspect (1). Of course, the image forming apparatus relating to Aspect (13) may also adopt modes comprising devices which realize the modes of inventions (2) to (12).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming method of ejecting liquid droplets containing coloring material toward a recording medium from nozzles including main nozzles and subsidiary nozzles of nozzle rows of a recording head while causing relative movement between the recording medium and the recording head in a relative movement direction that is substantially perpendicular to a direction of alignment of the nozzles of each of the nozzle rows in such a manner that an image is formed by the coloring material on the recording medium, wherein the nozzle rows include first and second nozzle rows which have the main nozzles corresponding to a same coloring material of a particular color and at least one subsidiary nozzle row which includes the subsidiary nozzles corresponding to the same coloring material of the particular color; the first and second nozzle rows and the at least one subsidiary nozzle row are respectively arranged at different positions in terms of the relative movement direction; the at least one subsidiary nozzle row is disposed between the first and second nozzle rows; and the subsidiary nozzles are arranged in such a manner that positions of the subsidiary nozzles projected on a straight line in the direction of alignment of the nozzles of each of the nozzle rows are different from positions of the main nozzles projected on the straight line, and wherein the image forming method includes:

a measurement step of measuring an amount of inclination of the recording head with respect to the relative movement direction;

a correction judgment step of judging whether or not correction is necessary according to the amount of inclination measured in the measurement step; and a correction step of carrying out droplet ejection from at least a portion of the subsidiary nozzles, in place of droplet ejection from at least a portion of the main nozzles when judgment is made, in the correction judgment step, that the correction is necessary, so that the correction is performed.

2. The image forming method as defined in claim 1, wherein the at least one subsidiary nozzle row includes a third nozzle row and a fourth nozzle row; and in the correction step, the droplet ejection from the subsidiary nozzles of one nozzle row of the third and the fourth nozzle rows is carried out, in place of the droplet ejection from the main nozzles of one nozzle row of the first and second nozzle rows.

3. The image forming method as defined in claim 2, further including a nozzle row determination step of determining the one nozzle row of the third and the fourth nozzle rows, including the subsidiary nozzles from which the droplet ejection is carried out in place of the droplet ejection from the main nozzles of one nozzle row of the first and second nozzle rows in the correction step, according to a direction of the inclination measured in the measurement step.

4. The image forming method as defined in claim 1, wherein volumes of the liquid droplets ejected from the subsidiary nozzles and the main nozzles are substantially same.

5. The image forming method as defined in claim 4, wherein, in the correction step, the droplet ejection from the at least a portion of the subsidiary nozzles is carried out in place of all of the droplet ejection from the main nozzles of one nozzle row of the first and second nozzle rows.

6. The image forming method as defined in claim 1, wherein volume of the liquid droplets ejected from the subsidiary nozzles is smaller than volume of the liquid droplets ejected from the main nozzles.

7. The image forming method as defined in claim 6, further comprising a mode switching step of switching a recording operation between a first recording mode and a second recording mode in which recording is performed at a higher resolution than in the first recording mode, wherein when the recording operation is switched to the first recording mode in the mode switching step, the correction step is carried out.

8. The image forming method as defined in claim 6, wherein in the correction step, total number of the liquid droplets ejected from the at least a portion of the subsidiary nozzles in place of the droplet ejection from the at least a portion of the main nozzles is greater than total number of the liquid droplets scheduled to be ejected from the at least a portion of the main nozzles subject to the correction in a hypothetical case that no correction is carried out; and in the correction step, total volume of the liquid droplets ejected from the at least a portion of the subsidiary nozzles per unit surface area of the recording medium is less than total volume of the liquid droplets scheduled to be ejected from the at least a portion of the main nozzles subject to the correction in the hypothetical case that no correction is carried out.

9. The image forming method as defined in claim 6, wherein in the correction step, total number of the liquid droplets ejected from the at least a portion of the subsidiary nozzles in place of the droplet ejection from the at least a portion of the main nozzles is greater than total number of the liquid droplets scheduled to be ejected from the at least a portion of the main nozzles subject to the correction in a hypothetical case that no correction is carried out; and in the correction step, total surface area of dots on the recording medium created by the liquid droplets ejected from the at least a portion of the subsidiary nozzles per unit surface area of the recording medium is greater than total surface area of dots on the recording medium created by the liquid droplets scheduled to be ejected from the at least a portion of the main nozzles subject to the correction in the hypothetical case that no correction is carried out.

10. The image forming method as defined in claim 6, wherein, in the correction step, a replacement ratio of the at least a portion of the main nozzles from which the droplet ejection is replaced with the droplet ejection from the at least a portion of the subsidiary nozzles is varied in accordance with density of the image formed on the recording medium.

11. The image forming method as defined in claim 1, wherein, in the correction judgment step, the judgment of whether or not the correction is necessary is made according to variation in a distance in a direction perpendicular to the relative movement direction, between the main nozzles belonging to the first nozzle row and the main nozzles belonging to the second nozzle row, and a distance in the relative movement direction between the first and second nozzle rows.

12. The image forming method as defined in claim 1, wherein the nozzle rows include nozzle rows which correspond respectively to cyan, magenta, yellow and black coloring materials, at least; and the particular color is at least one of cyan and magenta.

13. An image forming apparatus comprising:

a recording head which has nozzle rows having nozzles including main nozzles and subsidiary nozzles, the nozzle rows including first and second nozzle rows which include the main nozzles corresponding to a same coloring material of a particular color and at least one subsidiary nozzle row which includes the subsidiary nozzles corresponding to the same coloring material of the particular color, the first and second nozzle rows and the at least one subsidiary nozzle row being respectively arranged at different positions in terms of a relative movement direction that is substantially perpendicular to a direction of alignment of the nozzles of each of the nozzle rows, the at least one subsidiary nozzle row being disposed between the first and second nozzle rows, the subsidiary nozzles being arranged in such a manner that positions of the subsidiary nozzles projected on a straight line in the direction of alignment of the nozzles of each of the nozzle rows being different from positions of the main nozzles projected on the straight line;

a measurement device which measures an amount of inclination of the recording head with respect to the relative movement direction;

a correction judgment device which judges whether or not correction is necessary according to the amount of inclination measured by the measurement device; and a correction device which carries out droplet ejection from at least a portion of the subsidiary nozzles, in place of droplet ejection from at least a portion of the main nozzles when judgment is made, by the correction judgment device, that the correction is necessary, in such a manner that the correction is carried out, wherein the recording head ejects liquid droplets containing coloring material toward a recording medium while relative movement is caused between the recording medium and the recording head in the relative movement direction in such a manner that an image is formed by the coloring material on a recording medium.

* * * * *